US008910967B2

(12) United States Patent
Bjertnaes et al.

(10) Patent No.: US 8,910,967 B2
(45) Date of Patent: Dec. 16, 2014

(54) SKI BINDING

(75) Inventors: Gunner Bjertnaes, Biri (NO); Thomas Alsgaard, Nannestad (NO)

(73) Assignee: Madshus AS, Biri (NO)

( * ) Notice: Subject to any disclaimer, the term of this patent is extended or adjusted under 35 U.S.C. 154(b) by 0 days.

(21) Appl. No.: 13/877,642

(22) PCT Filed: Oct. 4, 2011

(86) PCT No.: PCT/EP2011/067281
§ 371 (c)(1),
(2), (4) Date: Jun. 26, 2013

(87) PCT Pub. No.: WO2012/045723
PCT Pub. Date: Apr. 12, 2012

(65) Prior Publication Data

US 2013/0270797 A1 Oct. 17, 2013

(30) Foreign Application Priority Data

Oct. 4, 2010 (EP) ..... PCT/EP2010/064729
Dec. 20, 2010 (EP) ..... PCT/EP2010/070184

(51) Int. Cl.
*A63C 9/00* (2012.01)
*A63C 9/20* (2012.01)

(52) U.S. Cl.
CPC ..... *A63C 9/003* (2013.01); *A63C 2009/008* (2013.01); *A63C 9/20* (2013.01); *A63C 9/005* (2013.01)
USPC ..... 280/611; 280/633; 280/634; 280/618; 280/617

(58) Field of Classification Search
CPC ..... A63C 9/00; A63C 9/005; A63C 6/003; A63C 10/16
USPC ..... 280/607, 618, 611, 617, 616, 613, 633, 280/634
See application file for complete search history.

(56) References Cited

U.S. PATENT DOCUMENTS 3,987,553 A 10/1976 Salomon
3,989,274 A * 11/1976 Weigl et al. ..... 280/634
(Continued)

FOREIGN PATENT DOCUMENTS

EP 1 652 560 A1 5/2006
EP 2 082 789 A1 7/2009
(Continued)

OTHER PUBLICATIONS

International Search Report and Written Opinion mailed Dec. 30, 2011, issued in corresponding International Application No. PCT/EP2011/067281, filed Oct. 4, 2011, 8 pages.

*Primary Examiner* — Hau Phan
(74) *Attorney, Agent, or Firm* — Christensen O'Connor Johnson Kindness PLLC

(57) ABSTRACT

A binding (1, 100) for a ski, in particular a ski binding for a cross-country or touring ski is described, in which a portion is adapted to interact with the ski, or a mounting plate (2, 110) attached to the ski, for attaching the binding to the ski in a displaceable manner, such that the binding can be positioned in a plurality of locations on the ski. A toothed interaction device (120), which is arranged so as to interact with matching indents or notches (112) on the ski or on the mounting plate (110), is provided, wherein the interaction of the teeth of the toothed interaction device with the matching indents or notches on the ski, or mounting plate, one or more than one of: determines, changes and/or fixes the position of the binding with respect to the ski.

18 Claims, 16 Drawing Sheets

(56) References Cited

U.S. PATENT DOCUMENTS

| | | | | |
|---|---|---|---|---|
| 4,955,633 | A * | 9/1990 | Stritzl et al. | 280/633 |
| 5,116,073 | A * | 5/1992 | Goud | 280/617 |
| 5,611,559 | A * | 3/1997 | Luitz et al. | 280/617 |
| 5,794,962 | A * | 8/1998 | Bardin et al. | 280/607 |
| 6,824,158 | B1 * | 11/2004 | Keller et al. | 280/618 |
| 6,848,704 | B2 * | 2/2005 | Lucas | 280/613 |
| 7,036,842 | B2 * | 5/2006 | Krumbeck et al. | 280/618 |
| 7,275,757 | B2 * | 10/2007 | Hoesl et al. | 280/617 |
| 7,448,641 | B2 * | 11/2008 | Buquet et al. | 280/607 |
| 7,571,923 | B2 * | 8/2009 | Baumgartner et al. | 280/611 |
| 7,988,180 | B2 * | 8/2011 | Holzer et al. | 280/616 |
| 2002/0101060 | A1 * | 8/2002 | Gorza et al. | 280/611 |

FOREIGN PATENT DOCUMENTS

| | | | |
|---|---|---|---|
| FR | 2 382 247 | A1 | 9/1978 |
| WO | 88/04563 | A1 | 6/1988 |

* cited by examiner

SKI BINDING

BACKGROUND TO THE INVENTION

The present disclosure relates to a ski binding, in particular a ski binding for a cross-country or touring ski, having a binding portion which can be shifted forwards and backwards relative to the ski by activating an actuator coupled to the binding portion.

Skiing and in particular cross-country skiing or touring skiing is a popular winter sport suitable for many people. In the cross-country skiing the arms and legs move parallel to the direction of travel and with the same synchronized rhythm as walking or running. When out walking or running, if every time the skier took a step forward, his/her forward momentum carried twice as far as his/her normal stride would take him/her. That is classical skiing. Classical skiing depends on kicking and gliding. The kick is like a walking or running step; it is how the skier moves forward. Each kick sends the skier gliding down the trail.

Accordingly, the cross-country skis have two distinct base sections. The tip and tail portion of the base are called the "glide zones". The central portion of the ski is called the "kick zone". The glide zones are completely smooth. The kick zone may have what is called a "Contagrip" pattern, or fish scales milled into the base. As the skiers step forward, all their weight is on the kick zone and the "Contagrip" pattern is pressed into the snow. As an alternative, the kick zone can be covered with a special wax, the so called "kick wax". When a skier applies his/her weight to the ski, the kick zone comes in contact with the snow, the kick wax sticks to the snow and the skier is able to move forward. Different kick waxes are used for different conditions and there are a wide variety of kick waxes to match the variations in snow type. This is how classical skiers propel themselves forward. As the skier glides, the kick zone doesn't touch the snow because the skier's weight is spread over the smooth glide zones. During the glide phase, both the skis' tips and tails (the glide zones) will transfer the skier's weight to the snow, providing optimum glide. During the kick phase, the middle ⅓ of the kicking ski (the kick zone) will come into contact with the snow as the skier shifts their weight to just one ski, providing optimum kick. For a fast ski, it is therefore required to provide the skier with a smooth, predictable and consistent transition between the kick and glide phases in all snow conditions.

As it is well known, in order to enjoy this sport properly, it is necessary to have appropriate equipment. In particular, the skis and skis bindings for cross-country skiing must provide an appropriate fastening of the skier's boot to the ski, whilst also allowing the heel of the boot to leave the surface of the ski. An important aspect to be taken into account is the position of the bindings relative to the balance point (neutral balance). Depending on the physiology of the skier and other concomitant factors such as the snow or weather conditions, it could be more convenient to fix the ski behind the neutral point, so that the ski's tip will stay closer to the snow, or to fix the ski in front of the neutral point, so that the ski's tip will rise quicker.

Also, it is known that by properly adjusting the binding forwards and backwards relative to the longitudinal direction of the ski, the skier is able to adapt an individual kick and technique, thus creating a more relaxed and efficient style. In particular, moving the binding forward for classical cross-country skiing gives the skier a better foothold (kick), while moving it backwards gives the skier better glide.

In prior art, there is a variety of arrangements for adjusting front and/or rear jaws of the binding in the longitudinal direction of the ski (see for example DE 39 24 939 A1). However, these arrangements are often complicated in use and difficult to produce.

To find a remedy to this problem, WO 2005/113081 A1 proposes an adjusting device for a cross-country or telemark binding, which is simple to use and does not affect the functional reliability of the binding. In particular, the binding is mounted on the top face of a ski, especially on a mounting plate thereon, so as to be longitudinally displaceable and is lockable in a plurality of sliding positions by means of a locking device.

Although this system has the advantage of adjusting the position of the binding as needed in a simple way, in order to perform this adjustment the skier must stop skiing and take the skis off. This could be a strong hindrance in terms of time consuming, if the skier needs to slightly shifting the position of the binding relative to the skis, in order to quickly improve/optimize for example the kick performance at a ski slope during a ski running.

SUMMARY OF THE INVENTION

It is therefore an object of the present invention to provide a ski binding with improved performances. In particular, to provide a ski binding whose position can be adjusted relative to the longitudinal direction of the ski, while the skier is out skiing. This object is achieved by the ski binding according to claim 1. Further advantageous combinations and designs are given in the dependent claims there from.

A first aspect of the present disclosure relates to a ski binding which is preferably designed for a cross country or touring ski. The binding is generally provided with a section which is for attachment or interaction with a top surface of a ski. This interaction may be directly with the surface of the ski, or could be by means of an intermediate mounting plate; wherein the mounting plate is itself attached to the surface of the ski. The binding is attached in such a manner that it will move on the surface of the ski or mounting plate, and is thus held in a displaceable manner. In this way, it will be attached in an appropriately firm manner, however between a variety of different positions on the surface of the ski. In order to move the binding over the ski, or mounting plate, the binding is provided with some form of interaction device, wherein the device preferably has a series of teeth or extensions thereon which can interact with notches or ridges provided on the ski or mounting plate. Depending on the particular form of the toothed device, the binding can be moved over and then fixed at an appropriate portion of the ski as chosen by the user. In some examples the toothed device will rotate and move the binding with this rotation, or the tooth device will rotate out of interaction with the ridges or indents on the ski or mounting plate—thus allowing the movement of the binding over the surface of the ski.

Preferably, the toothed device is held in a rotatable manner in the binding, such that either the rotation of the device moves the interaction between the extensions or teeth and the ridges and will thus move the binding over the surface of the ski, or the rotation of the toothed device removes the teeth from interlocking interaction with the ridges on the ski or mounting plate thus allowing the movement of the binding to occur.

If the toothed device is in the form of cogwheel, it is possible for the teeth on the cogwheel to extend below the lower surface of the binding such that they would project into ridges, or the like, on the ski or mounting plate upper surface. In this manner, it is clear that rotation of the cogwheel will move the cogwheel through adjacent notches or indents and will lead to a translational movement of the cogwheel over the ski surface. Naturally, if the cogwheel is at a fixed location within the binding, whilst being held in a rotational manner, the rotation of the cogwheel will also mean that the binding moves with the translational movement which then moves the binding over the surface of the ski. It is also possible to provide the cogwheel with a section without any teeth, such that this orientation of the cogwheel could be used when first placing the binding into slidable interaction with the ski or mounting plate. Obviously, if the teeth project beneath the surface of the binding upon fixing of the binding to the mounting plate or ski, these will interfere with the binding plate or ski. The use of the section without teeth will allow for the slidable interaction and positioning of the binding on the ski.

Another possibility for the toothed device is one in which a rotation axis is formed and the teeth extend outward in a plane perpendicular to the rotation axis along one side of the axis. As would then be understood, rotation of this device along the rotation axis will move the teeth into and out of engagement with the ski or mounting plate, thus allowing the binding position to be chosen and fixed by the user. Preferably, the teeth would be of a semicircular shape, thus improving the rotation ease of the toothed device with the ski or mounting plate notches.

Instead of the single or multiple semicircular teeth described above, it is also possible to provide the teeth by means of a worm screw thread extending outward from the rotation axis. With such a design, rotation of the toothed device will lead to the worm screw being run through the notches or indents on the ski or mounting plate, and thus the position of the binding can be changed. Rotational movement of the worm screw within a fixed position of the binding will ensure that the binding is moved through the notches by rotation of the worm screw. If the worm screw is provided with a blank section at one point, this would allow the initial slidable interaction of the worm screw onto the ski or mounting plate. Of course, without such a blank section the binding could still be entered into the notches of the ski or mounting plate, however it would be necessary to rotate the worm screw the moment the interaction occurs.

In order to ease the rotation of the toothed device, this can be provided with a handle, wheel or lever, which extends outwards from the rotation axis. Depending upon the nature of the toothed device, the handle is provided in such a way that the easy rotation of the device around the rotation axis is facilitated. Further, if a handle is provided, it could be used to fix the location or position of the binding. The rotation of the toothed interaction device will allow either the direct motion of the binding, or the binding to be released from a fixed location. By fixing the handle with clips, or the like, into the binding, the rotation of the toothed device can be fixed and thus appropriate fixing of the binding is facilitated at the desired position on the ski.

It is also possible to provide the toothed interaction device as a separate removable cartridge. By providing the toothed interaction device with a separate housing which can be clip, or otherwise removably, fit with the binding, the toothed interaction device could be added to a binding after it has been roughly positioned at the desired location on the ski. Adding the toothed device removable cartridge after rough positioning, will then allow for the rotation of the toothed device to move the binding over the surface of the ski.

Another possibility is to provide the toothed interaction device as a cogwheel in which the teeth extend radially outward from a central rotation axis, wherein the rotation axis is provided by two extensions running in this axial direction. The binding may then be provided with an appropriate housing for holding the cogwheel, wherein the housing has a number of slots into which the extensions can be positioned so as to allow for rotation of the cogwheel to occur but no translational motion of the cogwheel to be possible. In the same way as above, this means that the cogwheel is in a fixed location on the binding, but with rotation of the cogwheel the binding can be moved across slots or indents on the surface of the ski. This is particularly the case if the teeth extend below the lower surface of the binding.

Either the cogwheel is provided with an axial hole running through the cogwheel and circular extensions, or with indents into the circular extensions and cogwheel in the axial direction. In the axial hole or indent there are positioned a number of radially inwardly projecting teeth, to form a structured axial hole or indent. The number of teeth advantageously, but not necessarily, matches the number of externally extending teeth on the outside of the cogwheel. Preferably, the cogwheel comprises two indents either side of the cogwheel, wherein both of these indents are aligned with the rotation axis of the cogwheel.

In order to interact with the cogwheel it is possible to provide a detachable handle. The handle could be provided in a generally H-shaped configuration, such that two ends of the legs forming the H could interact with the axial hole or indents on the cogwheel. By appropriately structuring a series of toothed extensions at the ends of the legs of the H handle, these can interact with the internally projecting indents on the cogwheel in either the axial hole or indents. In this manner, by providing the same number of internal teeth in the axial hole or indents, it is clear that the handle can always be positioned within the hole or indents, and will allow that complete rotation of the handle is possible to give maximum travel of the binding of the ski. Preferably, the toothed interaction device will be held under tension when attached to the cogwheel by ensuring that the teeth of the tooth projections are a little bit narrower than the width of the cogwheel in the axial direction; clearly this will stop the handle from accidentally disengaging during use.

In order to fix the position of the binding the binding may be provided with one or more clips into which the crosspiece of the H handle can be clipped. Obviously, the H-shape is a preferred design, as pushing on the upper side of the legs, this being the end without the toothed projections, will lead to the toothed projections being pulled apart slightly to allow interaction with the cogwheel. Obviously a different shape, for example an n. will also allow for this system to work, however without the advantageous lever action for opening and closing the gap.

The toothed interaction device of the binding may also be provided by means of a cogwheel in which the teeth extend radially outward from a rotation axis. Holding the cogwheel within the binding will thus allow for the rotational motion of the cogwheel, so that the teeth, which preferably extend below the binding, can be used to interact with ridges or slots on the ski or mounting plate. An axle can be provided through the centre of the rotation axis of the cogwheel, by means of a bolt-type fastener. Holding the cogwheel within a housing provided in the binding, allows the cogwheel to be held rotationally such that the binding can be positioned over the surface of the ski or mounting plate in a similar manner to that described above. In order to fix the cogwheel within the binding, a housing in the binding is provided which extends above the upper surface of the binding. The housing is sized such that the cogwheel will fit snugly therein, allowing rotation, but will also hold the cogwheel firmly in position such that no translational motion between the cogwheel and binding could occur. In this manner, it is clear that if the cogwheel is fixed in a non-rotational manner by some mechanism, the binding will also be fixed around the cogwheel and thus the cogwheel interacting with the mounting plate or ski will be able to hold the binding at the desired position on the ski surface.

The housing can be structured such that the end faces of the cogwheel can be accessed either side of the housing. This could be achieved by means of the cogwheel being provided with two axial extensions, in a similar manner to that described above, which fit within two appropriate slots in the side faces of the housing which can hold the extensions in the axial direction and thus properly hold the cogwheel in a rotational manner into the binding. A gap is structured between the heads of the bolt fastener pieces, such that two frictional surfaces of a handle can be positioned between the bolt fastener heads and the end surfaces of the cogwheel. By providing the handle with two frictional inwardly facing regions, which are positioned facing the end faces of the cogwheel or the end faces of the extensions in the axial direction of the cogwheel, it is clear that tightening of the bolt fastener will bring the frictional faces into frictional engagement with the end faces of the cogwheel and thus hold the handle and cogwheel together as a single unit. It will be understood that rotation of the handle at this point will lead to rotation of the cogwheel, and then when the binding is held on a mounting plate or ski surface with the teeth of the cogwheel interacting with notches or indents, the rotation of the cogwheel via the handle will lead to the translational motion of the binding over the ski surface.

The bolt fastener is preferably provided by means of an outer tubular element which has a hollow tubular interior with an internal screw thread therein. A bolt or screw element can then be positioned such that it will screw interface with this internal screw and thus bring the bolt fastener to a tighter or looser holding. As is clear, the system then functions by the binding being positioned on the surface of the ski at roughly the desired point, and the bolt fastener is tightened such that the internal screw works within the internal screw thread and holds the handle in a frictional engagement with the end surfaces of the cogwheel such that the handle and cogwheel will move as a single unit.

It is possible to provide the above-described binding with a kit in which a mounting plate is provided. The mounting plate would be provided such that it could attach to the surface of the ski, wherein the mounting plate comprises the notches for interacting with the appropriate rotation device provided with teeth. A spacer may be provided either between the binding and the mounting plate, or between the mounting plate and the ski. The spacer plate would, if positioned on top of the mounting plate, be provided with the appropriate notches to interact with the toothed device of the binding.

DETAILED DESCRIPTION

Figure 1:
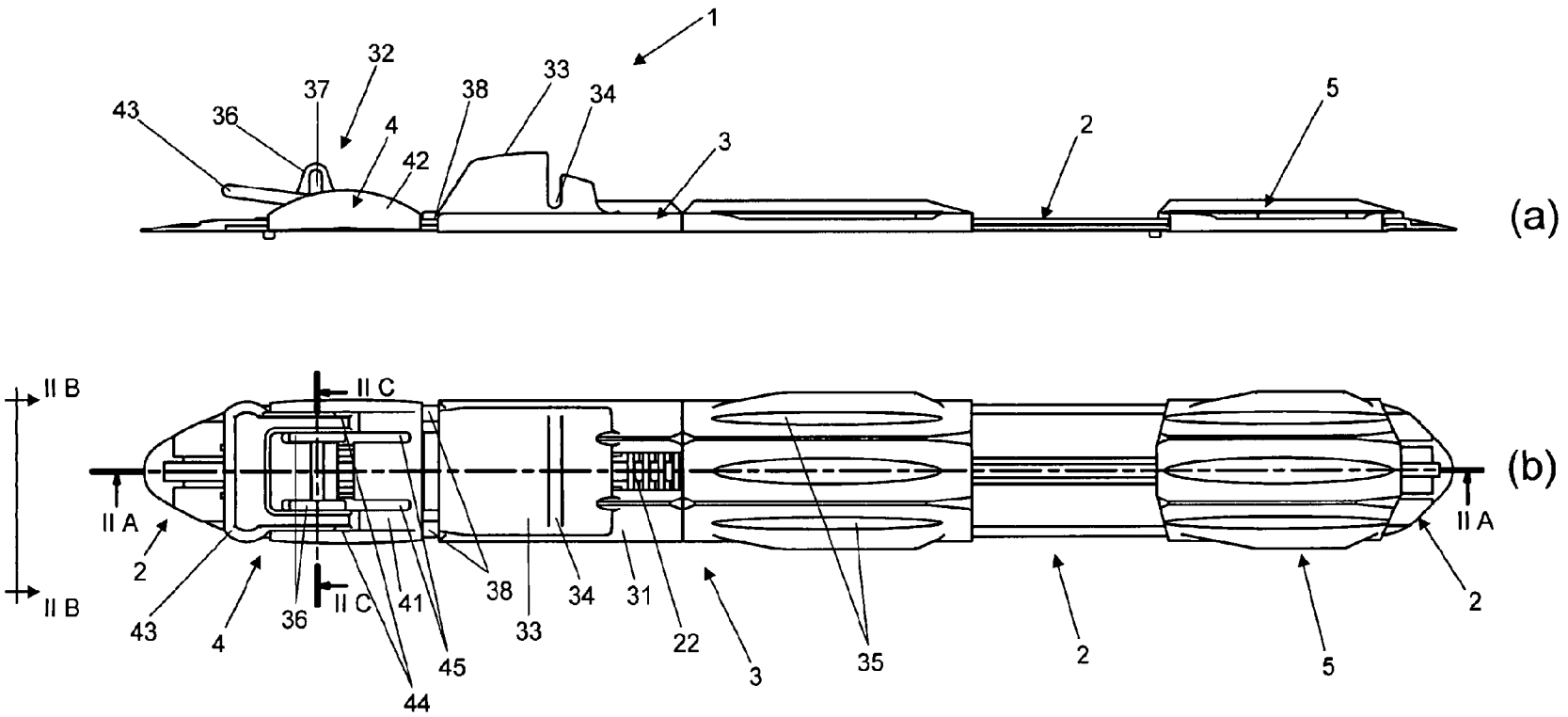
FIG. 1*a* and FIG. 1*b* show side and top views of the ski binding according to a first embodiment of the present disclosure displaced on a mounting plate.

FIGS. 1*a* and 1*b* show a side and a top view of a ski binding 1 for cross-country skiing, wherein the actuator is a lever system. The ski binding 1 is mounted on a mounting plate 2. The mounting plate 2 is suitable for locating the ski binding 1 at one end and locating a heel plate 5, formed separately there from, at the other end. In order to fix the ski binding 1 and the heel plate 5 on the mounting plate 2, the ski binding 1 and the heel plate 5 are provided with locking members in the form of teeth (not shown in the figures) and the mounting plates 2 with counter locking members 22 in the form of notches. The ski binding 1 comprises a first unit 3 having a first unit plate 31 and a second unit 4 having a second unit plate 41, which are connected to each other through a connecting means 32.

The first unit 3 comprises a binding portion 33 for interacting with the shoe sole of a ski boot. In particular, the pivot axis associated with the shoe sole (not shown in the figures), can be accommodated in the retaining element 34 of the binding portion 33. In the present case, the retaining element 34 has the form of a hook. To accommodate the tread layer of the shoe sole, the first unit 3 furthermore comprises longitudinal guide ribs 35 for the front portion and the heel plate 5 guide ribs 51 for the rear portion. This binding is designed for boots the soles of which each have, at a spacing from the front end of the sole, a sole-associated engagement element which so co-operates with a complementary associated binding portion 33 that the heel of the boot can be lifted up. Between the sole-associated engagement element and the front end of the sole of the associated boot there is formed, in the sole, a projecting part which can be so brought into contact with a binding associated catch (not shown in the figure) that the boot is held in engagement by means of the binding portion 33 and, at the same time, can carry out a movement upwards and downwards about a notional transverse axis behind the catch. The binding portion 33, and consequently a boot connected thereto, is capable of pivoting upwards about an horizontal axis extending across the longitudinal direction of the boot and the binding, against the action of a resilient element, such as a compression spring. The sole-associated engagement element is a transverse axis arranged inside a sole recess, as is already known for cross-country or telemark ski boots.

The second unit 4 comprises a second unit housing 42 and a movable actuator 43 protruding from the housing 42. The actuator 43 is coupled to the first unit 3 by means of the connecting means 32. The actuator 43 is a lever system having a U-shaped form with two arms and is pivotally mounted on the second unit housing 42 by two axles 44. The connecting means 32 is an extension of the first unit 3 and is inserted in the housing 42 and comprises connecting stripes 38, which are connected to the first unit 3 at one end and to a pair of jaws 36 extending vertically out of the housing 42 and having longitudinally extending slots 37 at the other end. In particular, the arms of the actuator 43 are coupled to the jaws 36 of the connecting means 32 in order to transfer the movement of the actuator 43 to the connecting means 32 and then to the first unit 3. Specifically, the arms of the actuator 43 are provided each with a pin 46 (shown in FIG. 2*c*), which penetrates in each of the slots 37 of the jaws 36. The second unit 4 furthermore comprises two transverse slots 45 in the housing 42 for receiving the jaws 36 of the connecting means 32 and for allowing these jaws 36 to slide forwards and backwards relative to the second unit 4 when the actuator 43 is moved.

Figure 2:
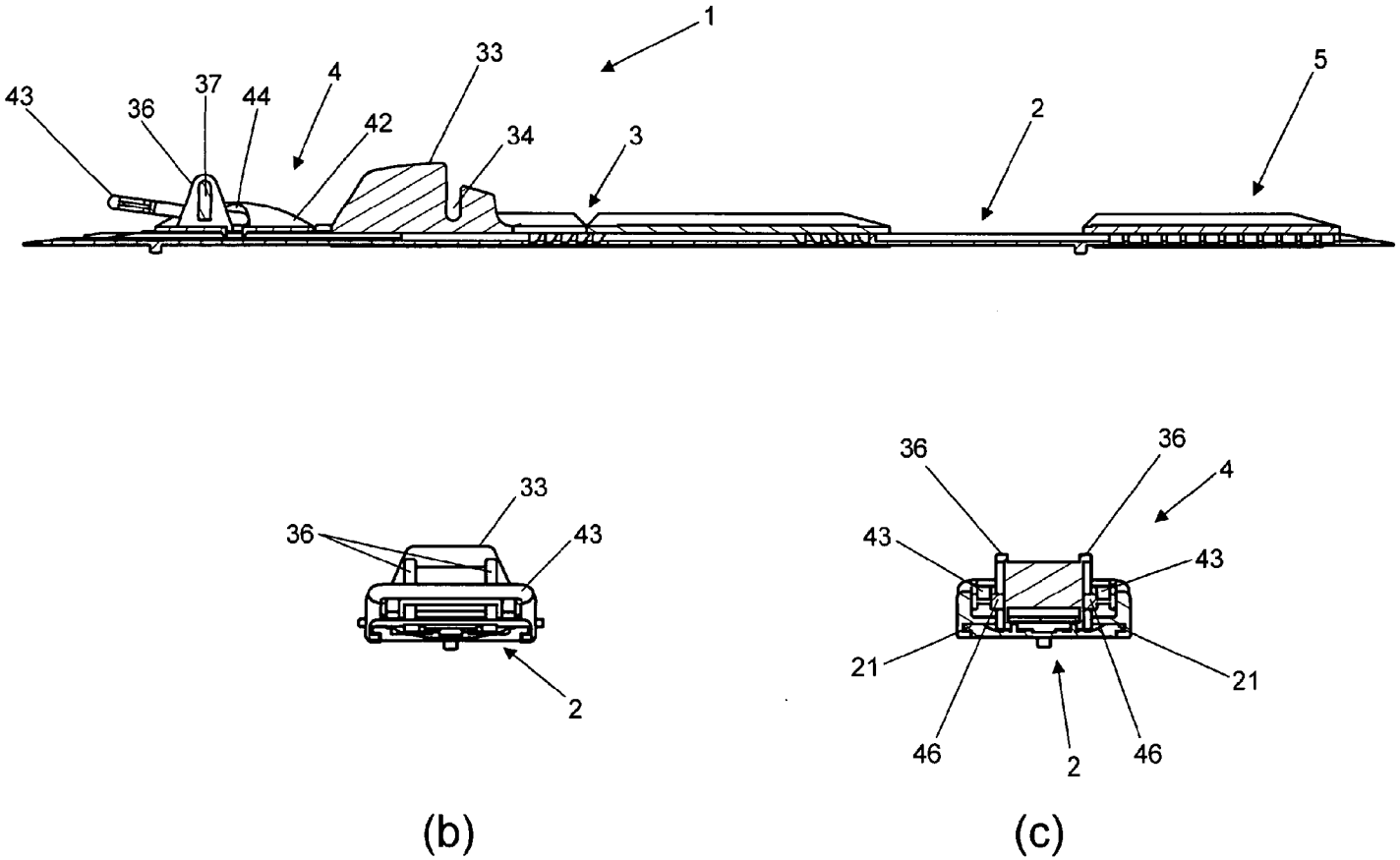
FIG. 2*a*, FIG. 2*b* and FIG. 2*c* show a cross section of the ski binding of FIG. 1, as viewed along the section A-A (FIG. 2*a*), a front view of the ski binding of FIG. 1 as viewed along the line B-B (FIG. 2*b*) and a cross section of the ski binding of FIG. 1, as viewed along the section C-C (FIG. 2*c*)

FIG. 2*a* shows the system of FIG. 1 as viewed along the section A-A. Form this section, it is clear that the actuator 43 can be pivotally moved relative to the second unit's housing 42 with respect to the rotational axis 44. Due to the coupling between the jaws 36 and the arms of the actuator 43, the movement of the actuator 43 is transferred to the connecting means 32.

FIG. 2*b* shows the front view of the system of FIG. 1. The actuator 43 is located in front of the binding portion 33, thereby not affecting the functional performances of the ski.

FIG. 2*c* illustrates a cross section of the system of FIG. 1 as viewed along the section C-C. This figure in particular shows that the coupling between the jaws 36 and the actuator 43 is performed by means of the engagement between the pins 46 of the arms of the actuator 43 and the slots 37 of the jaws 36. Furthermore, FIG. 2*c* shows that the mounting plate 2 is T-shaped in cross-section 21 and that the second unit 4 engages beneath the two lateral longitudinal edges of the mounting plate 2.

Figure 3:
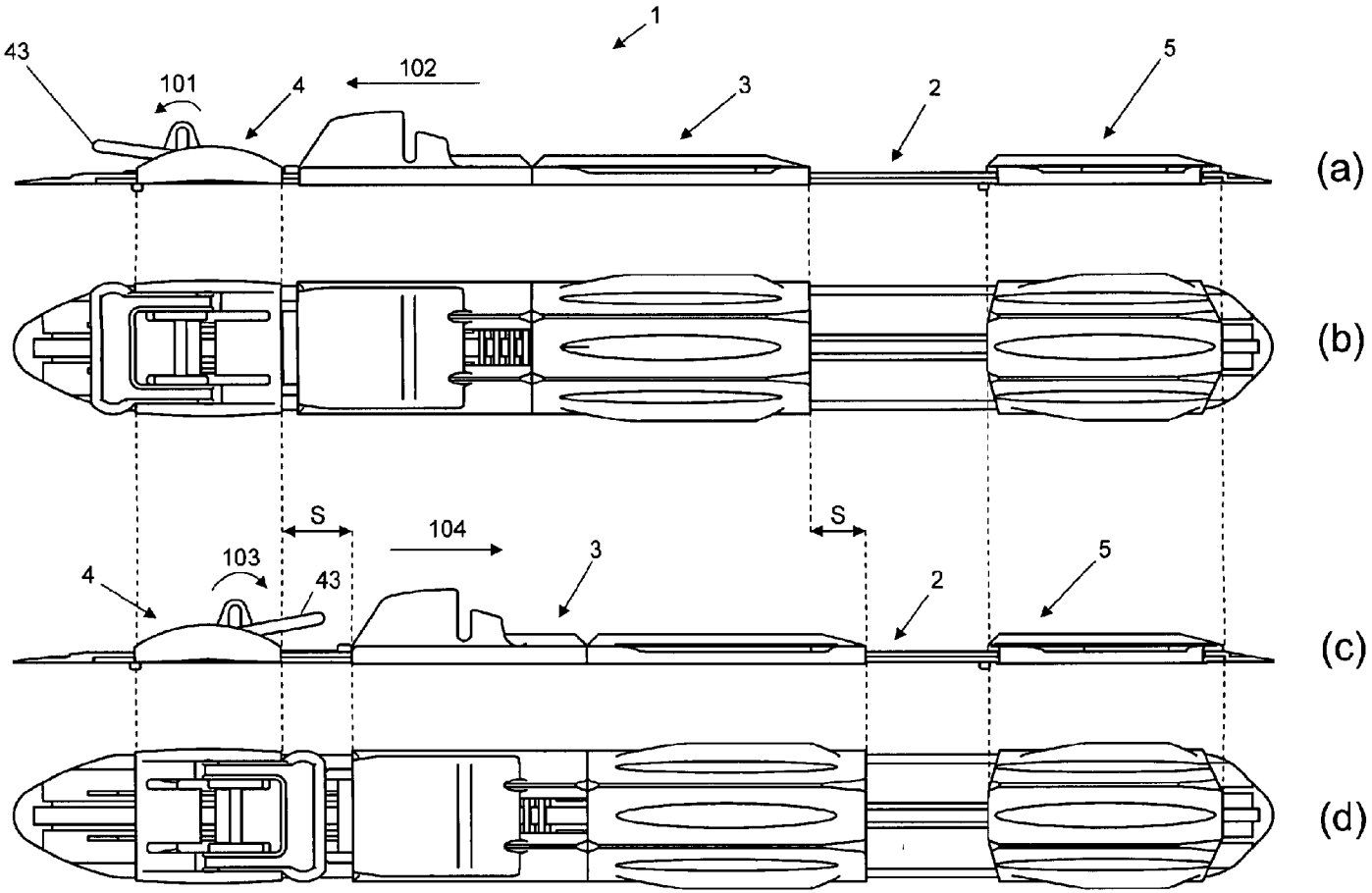
FIG. 3*a*, FIG. 3*b*, FIG. 3*c* and FIG. 3*d* show side and top views of the ski binding according to a first embodiment of the present disclosure displaced on a mounting plate, as viewed in the first, kick position and the second, glide position.

FIGS. 3*a*, 3*b*, 3*c*, and 3*d* show a comparison between the side and a top view of a ski binding 1 in "kick position" (FIGS. 3*a* and 3*b*) and in "glide position" (FIGS. 3*c* and 3*d*). In the kick position, the actuator 43 is moved in the direction of the arrow 101. Accordingly, the first unit 3 is shifted forwards in the direction of the arrow 102. In the glide position, the actuator 43 is moved in the direction of the arrow 103. Accordingly, the first unit 3 is shifted backwards in the direction of the arrow 104. By moving back the actuator 43 in the direction of the arrow 101, the first unit 3 is shifted to the kick position again. Form the comparison of these figures, it is possible to notice that during the movement from the kick to the glide position and vice versa, only the first unit 3 shifts forwards and backwards by a maximum quantity S with respect to the mounting plate 2. On the other hand, the second unit 4 and the heel plate 5 remain fixed in their positions relative to the mounting plate 2.

Figure 4:
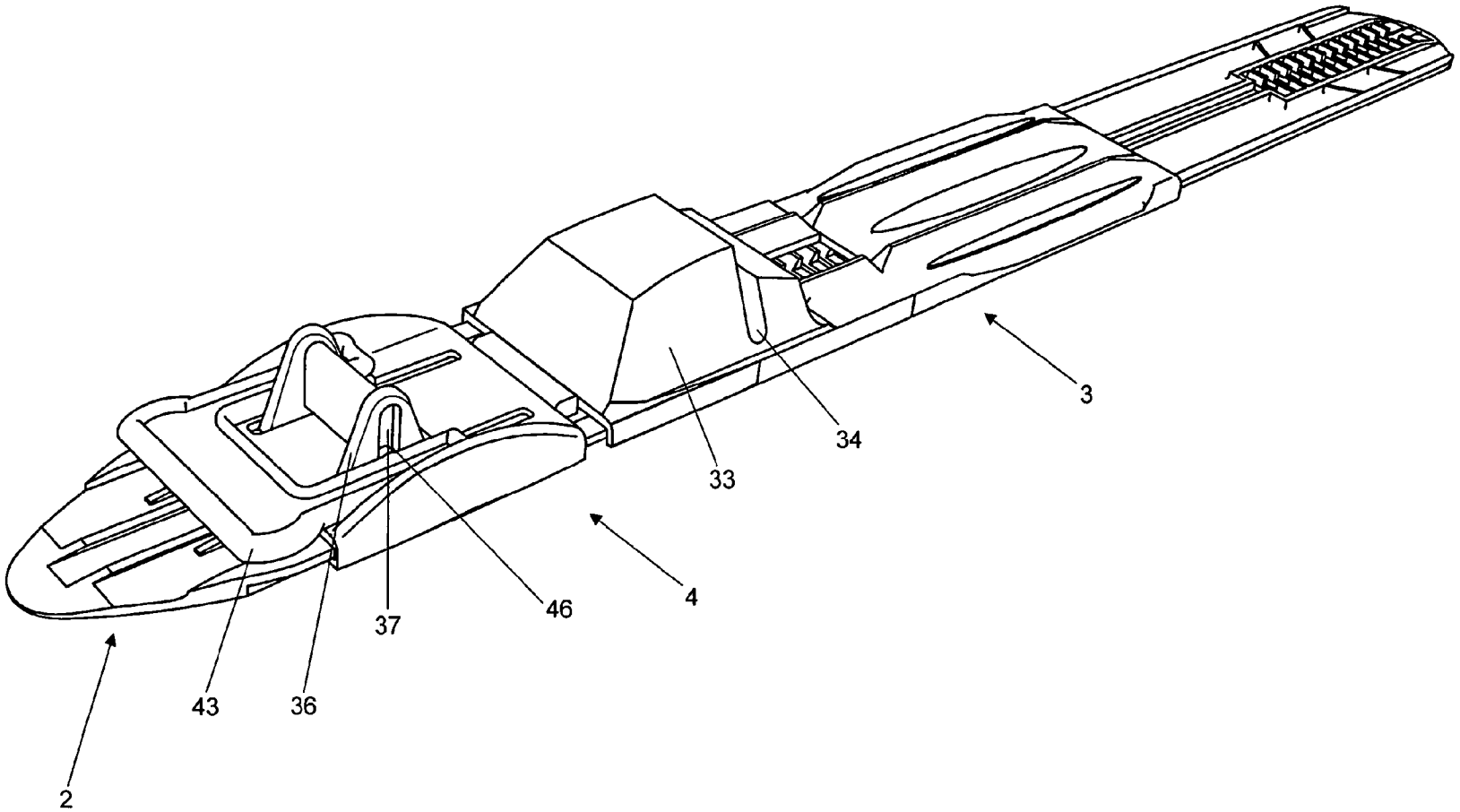
FIG. 4 shows a perspective view of the ski binding according to a first embodiment of the present disclosure displaced on a mounting plate, as viewed in the first, kick position.
Figure 5:
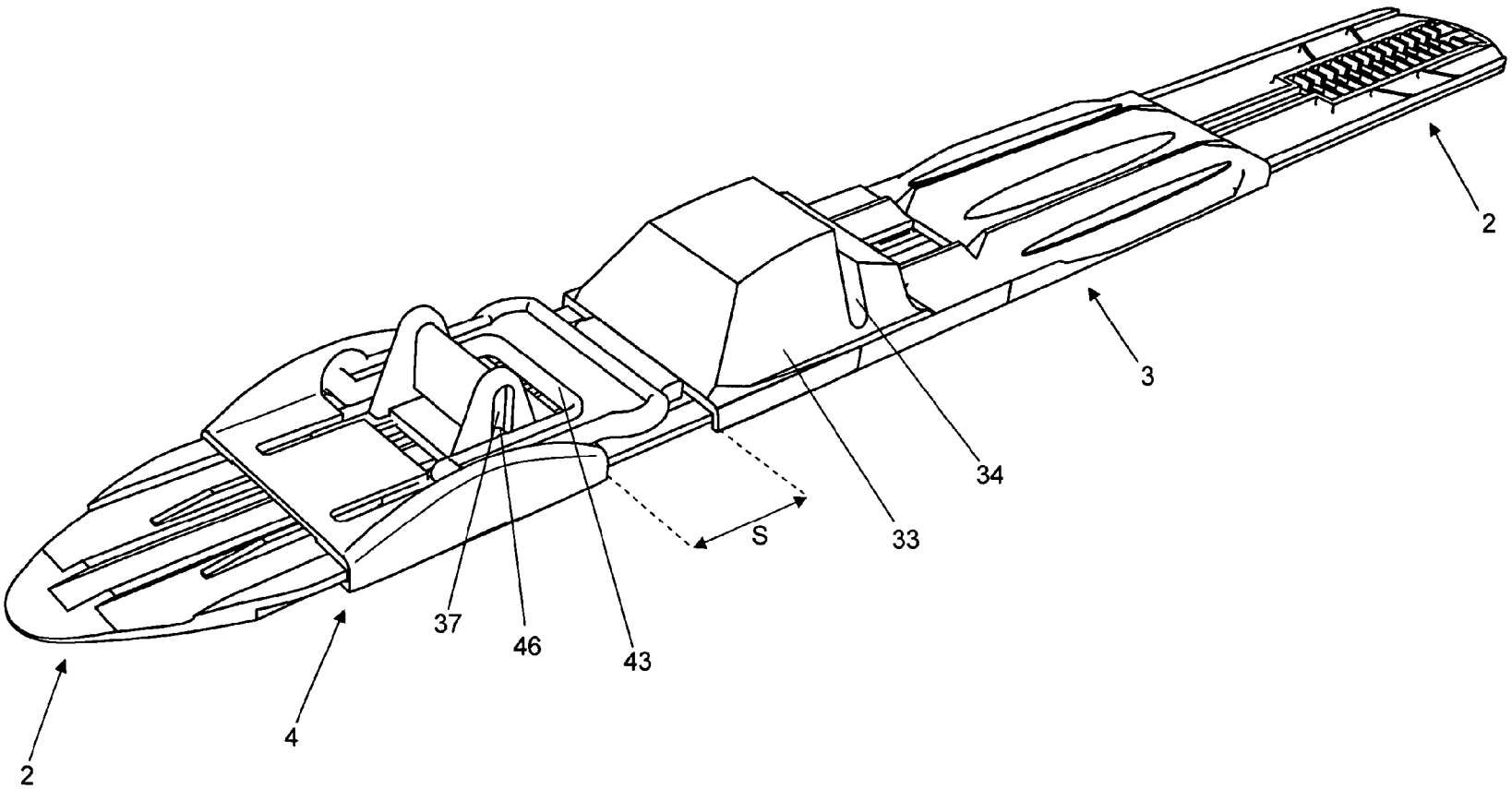
FIG. 5 shows a perspective view of the ski binding according to a first embodiment of the present disclosure displaced on a mounting plate, as viewed in the second, glide position.

FIG. 4 and FIG. 5 show the comparison between the "kick position" (FIG. 4) and "glide position" (FIG. 5) in a perspective view. Here, the maximum shift S of the first unit 3 with respect to the mounting plate 2 can be better appreciated.

Figure 6:
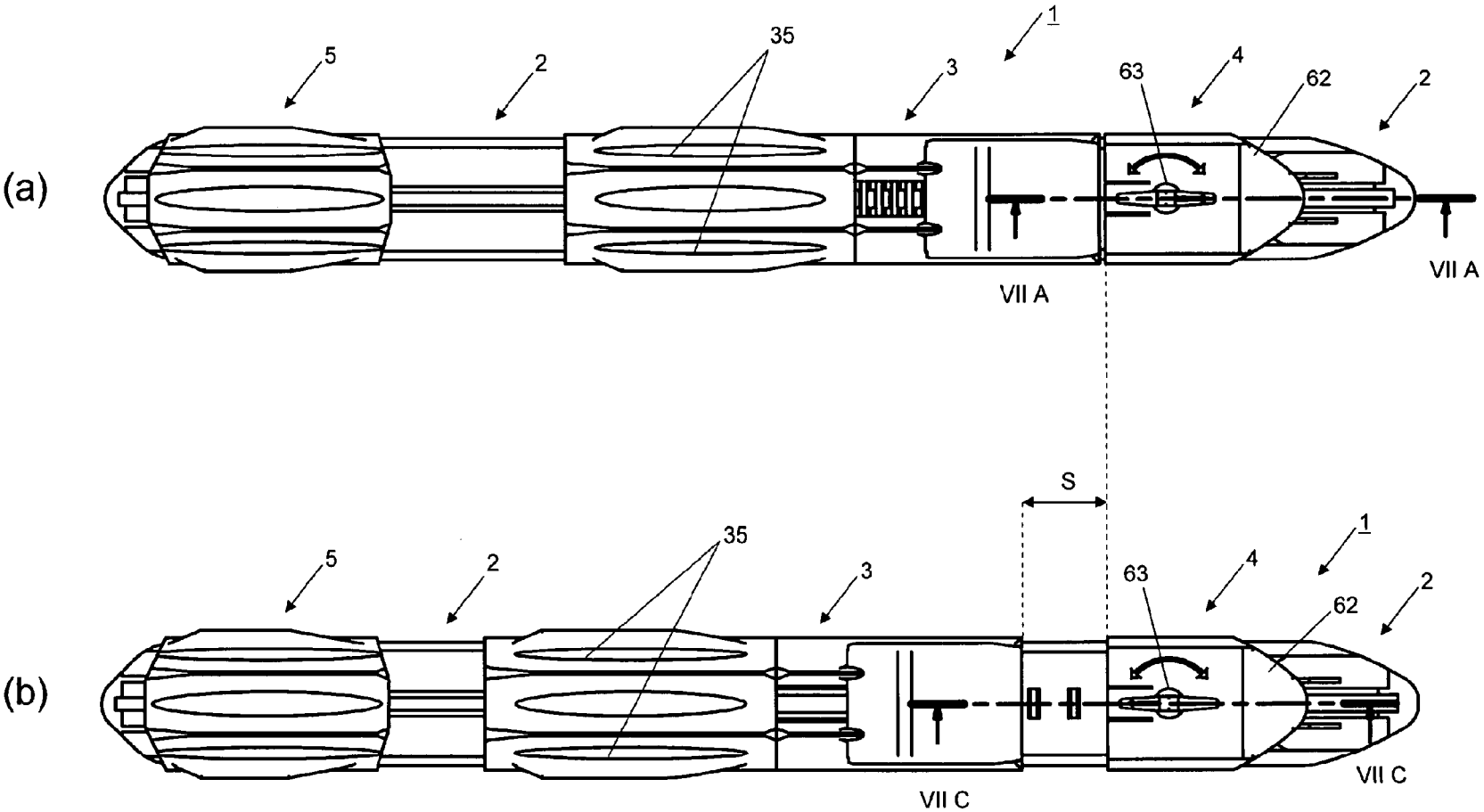
FIG. 6*a* and FIG. 6*b* show top views of the ski binding according to a second embodiment of the present disclosure displaced on a mounting plate.

FIGS. 6*a* and 6*b* show a top view of a ski binding 1 for cross-country skiing, wherein the actuator is a rotatable knob. This ski binding 1 is similar in construction to that illustrated in FIG. 1*a* and FIG. 1*b*. Accordingly, the same reference numerals have been used for the same elements. The ski binding 1 of FIG. 6 differentiates from that of FIG. 1 in that the second unit 4 comprises a second unit housing 62 and a rotatable actuator 63 protruding from the housing 62. The actuator 63 can be rotated clockwise or counter-clockwise (see double arrows in the figures). Based on the rotation of the actuator 63, the first unit 3 is moved to the first, kick position (FIG. 6*a*) or to the second, glide position (FIG. 6*b*).

Figure 7:
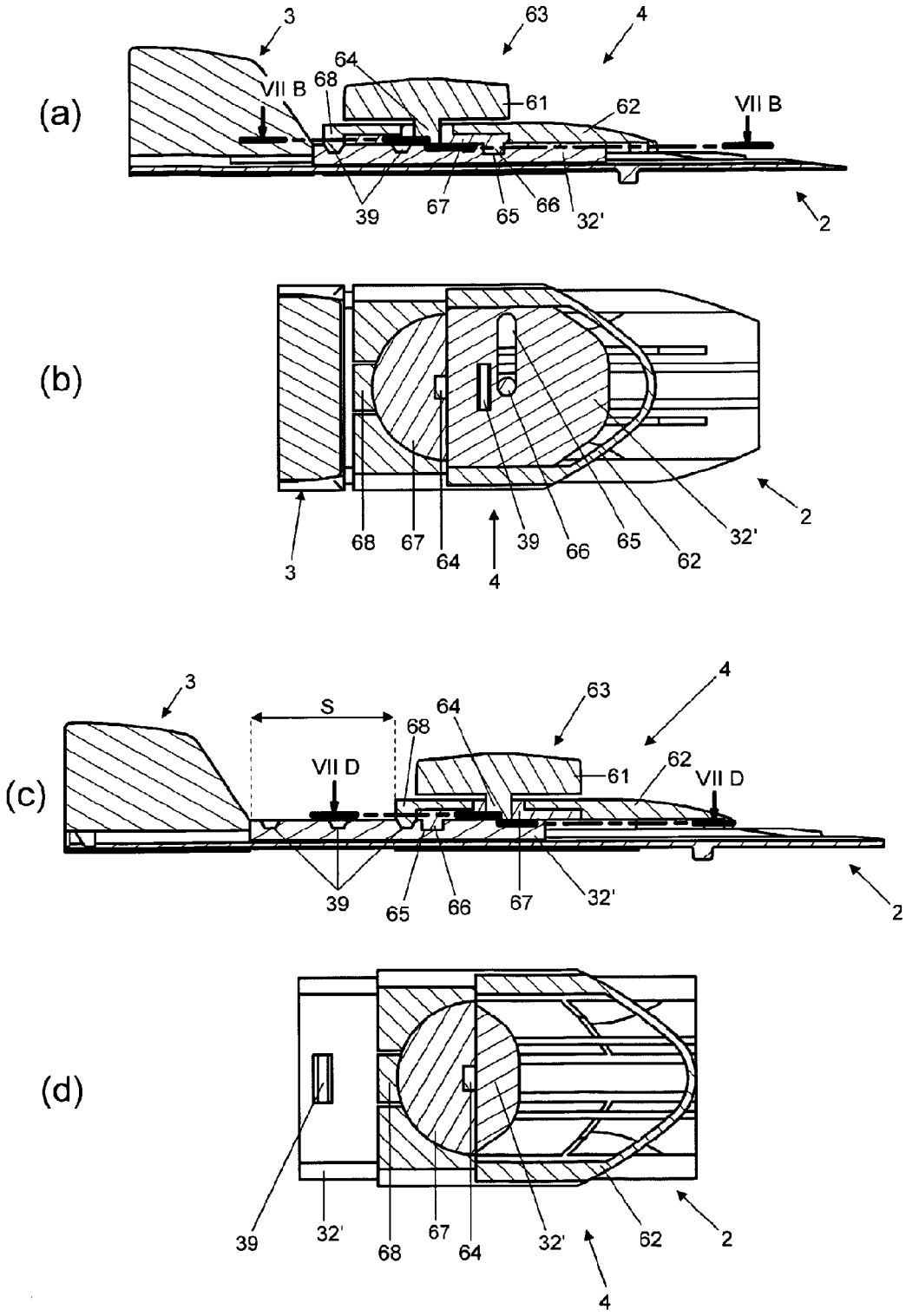
FIG. 7*a*, FIG. 7*b*, FIG. 7*c* and FIG. 7*d* show a cross section of the ski binding of FIG. 6*a* and FIG. 6*b*, as viewed along the section A-A (FIG. 7*a*) and the section C-C (FIG. 7*c*) and a cross section of the second unit of FIG. 7*a* and FIG. 7*c*, as viewed along the section B-B (FIG. 7*b*) and D-D (FIG. 7*d*)

FIGS. 7*a* and 7*c* illustrate a cross section of the system of FIG. 6*a* and FIG. 6*b* as viewed along the sections A-A and C-C, respectively. In particular, these figures show a detail of the second unit 4, when the first unit 3 is in the kick position (FIG. 7*a*) or in the glide position (FIG. 7*c*). The second unit 4 comprises a rotatable actuator 63 having a stem 64, which at one end is connected to an elongated head 61 and at the other end is connected to a coupling means 67, which has the form of a disk. The ski binding 1 comprises a connecting means 32' which is an extension of the first unit 3 and is slidable beneath the housing 62. The coupling means 67 is provided with a pin 66 which is inserted in a slot 65 of the connecting means 32' and the housing 62 is provided with a resilient catch tab 68 which can be inserted in one of the plurality of recesses 39 arranged longitudinally along the connecting means 32'. By comparing FIGS. 7*a* and 7*c* it is clear that a rotation of 180° of the actuator 63 determines a rotation of the coupling means 67 and therefore a translation of the connecting means 32' by a quantity S. Also, in the kick position (FIG. 7*a*) the catch tab 68 is inserted in the recess 39, which is the closest one to the first unit 3, while in the glide position (FIG. 7*c*) the catch tab 68 is inserted in the recess 39, which is the most distant one from the first unit 3.

FIGS. 7*b* and 7*d* illustrate a cross section of the second unit 4 of FIG. 7*a* and FIG. 7*c* as viewed along the broken sections B-B and D-D, respectively. In the kick position (FIG. 7*b*) the pin 66 is at one end of the longitudinal slot 65 and the slot 65 is located at one edge of the coupling means 67. In the glide position (FIG. 7*d*) the slot 65 is located at the other edge of the coupling means 67 (not shown) and is shifted backwards by a quantity corresponding to the length of the diameter of the coupling means 67.

Figure 8:
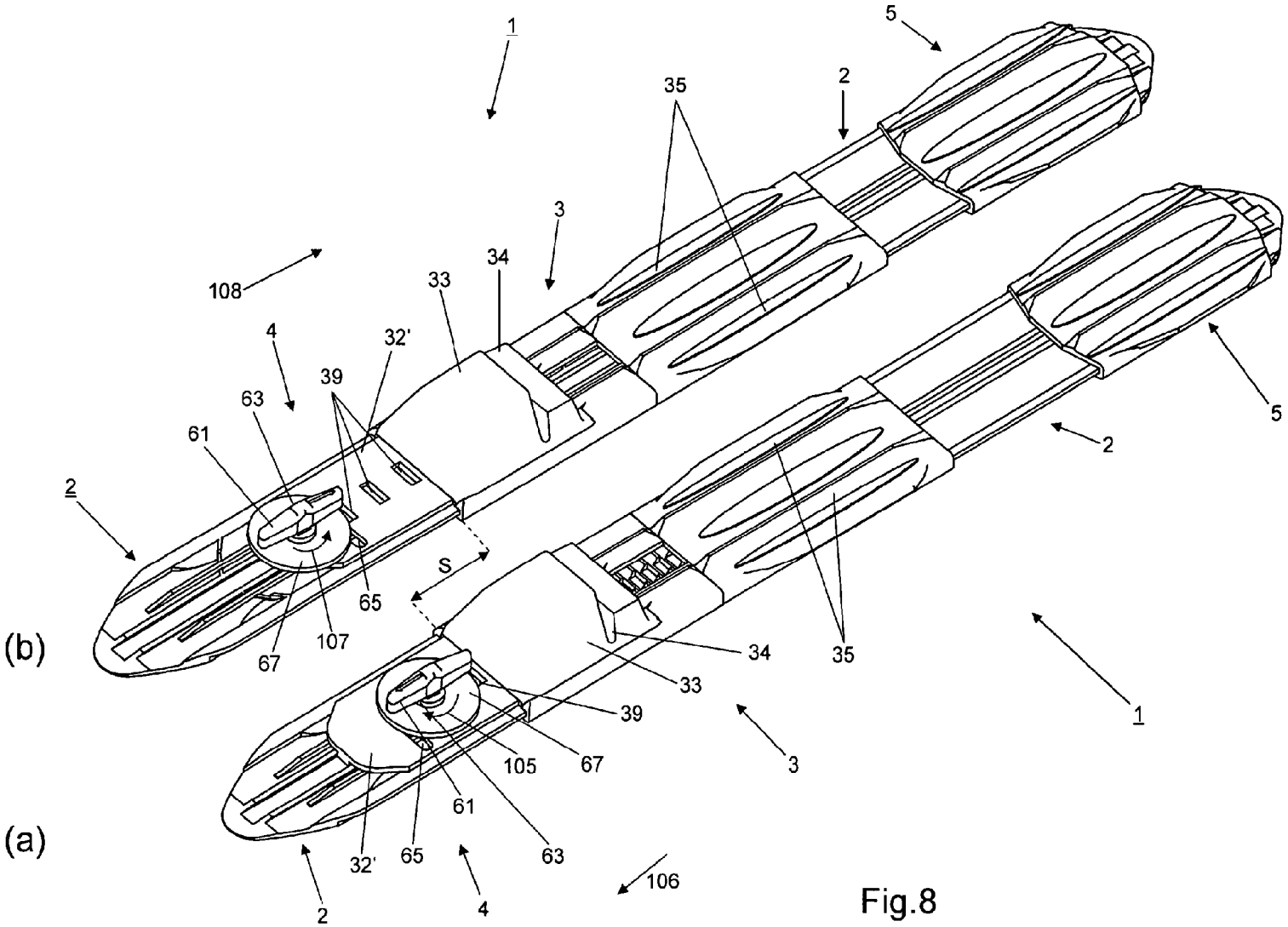
FIG. 8*a* and FIG. 8*b* show perspective views of the ski binding according to a second embodiment of the present disclosure without the housing of the second unit, as viewed in the first, kick position and the second, glide position.

FIGS. 8*a* and 8*b* show a comparison between a perspective view of a ski binding 1, wherein the actuator is a rotatable knob in "kick position" (FIG. 8*a*) and in "glide position" (FIG. 8*b*). In the kick position, the actuator 63 is moved in the direction of the arrow 105. Accordingly, the first unit 3 is shifted forwards in the direction of the arrow 106. In the glide position, the actuator 63 is moved in the direction of the arrow 107. Accordingly, the first unit 3 is shifted backwards in the direction of the arrow 108. By moving back the actuator 63 in the direction of the arrow 105, the first unit 3 is shifted to the kick position again. Form the comparison of these figures, it is possible to notice that during the movement from the kick to the glide position and vice versa, only the first unit 3 shifts forwards and backwards by a maximum quantity S with respect to the mounting plate 2. On the other hand, the second unit 4 and the heel plate 5 remain fixed in their positions relative to the mounting plate 2. The ski binding 1 of FIGS. 8*a* and 8*b* is shown without the housing 62 of the second unit 4, in order to appreciate the different positions of the recesses 39 of the connecting means 32' and the slot 65 during the kick and the glide positions. In particular, it can be noted that the connecting means 32' slides beneath the actuator 63 and that the slot 65 moves from one edge to the other edge of the coupling means 67.

Figure 9:
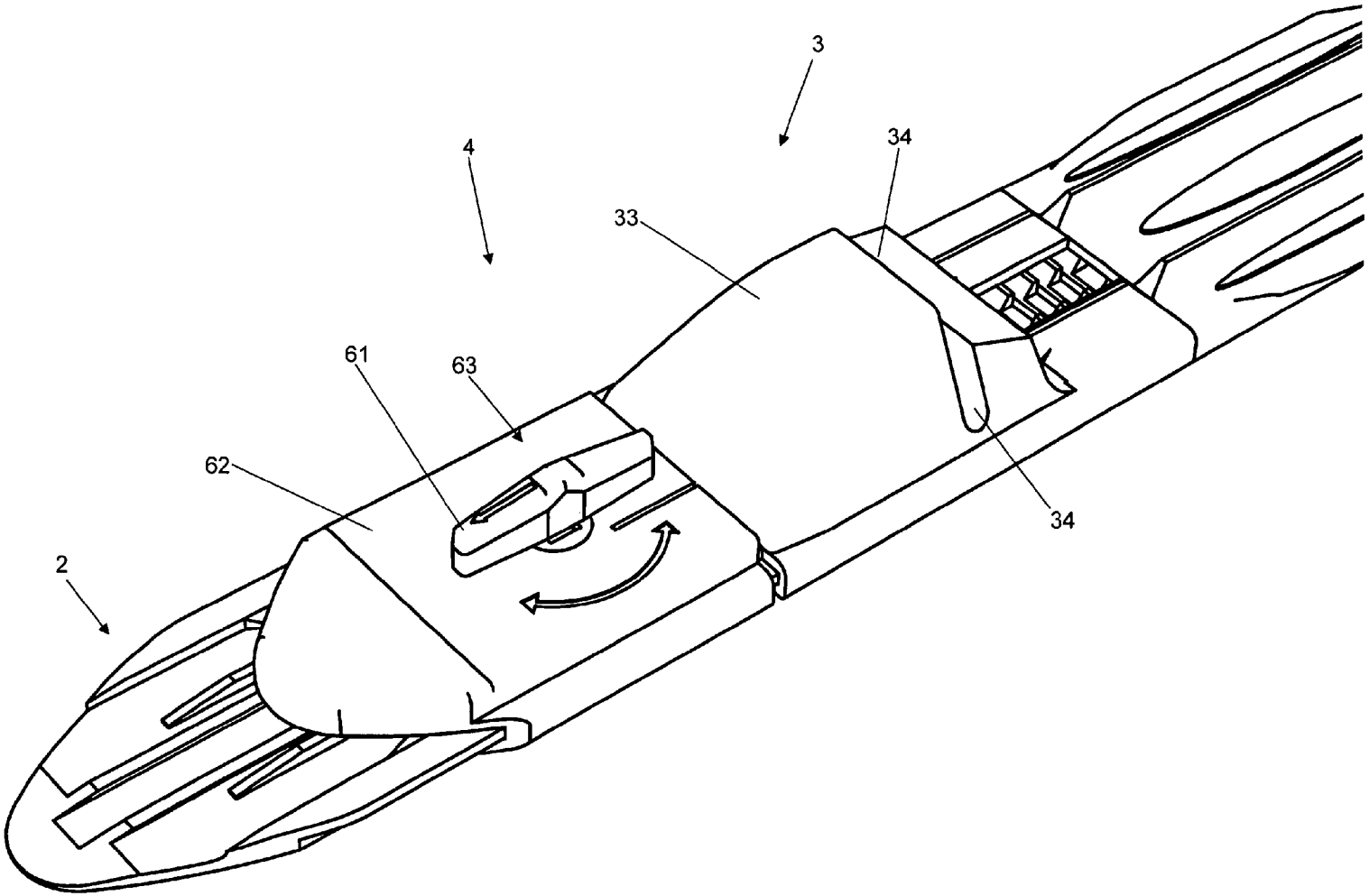
FIG. 9 shows a perspective view of the second unit according to a second embodiment of the present disclosure displaced on a mounting plate, as viewed in the first, kick position.
Figure 10:
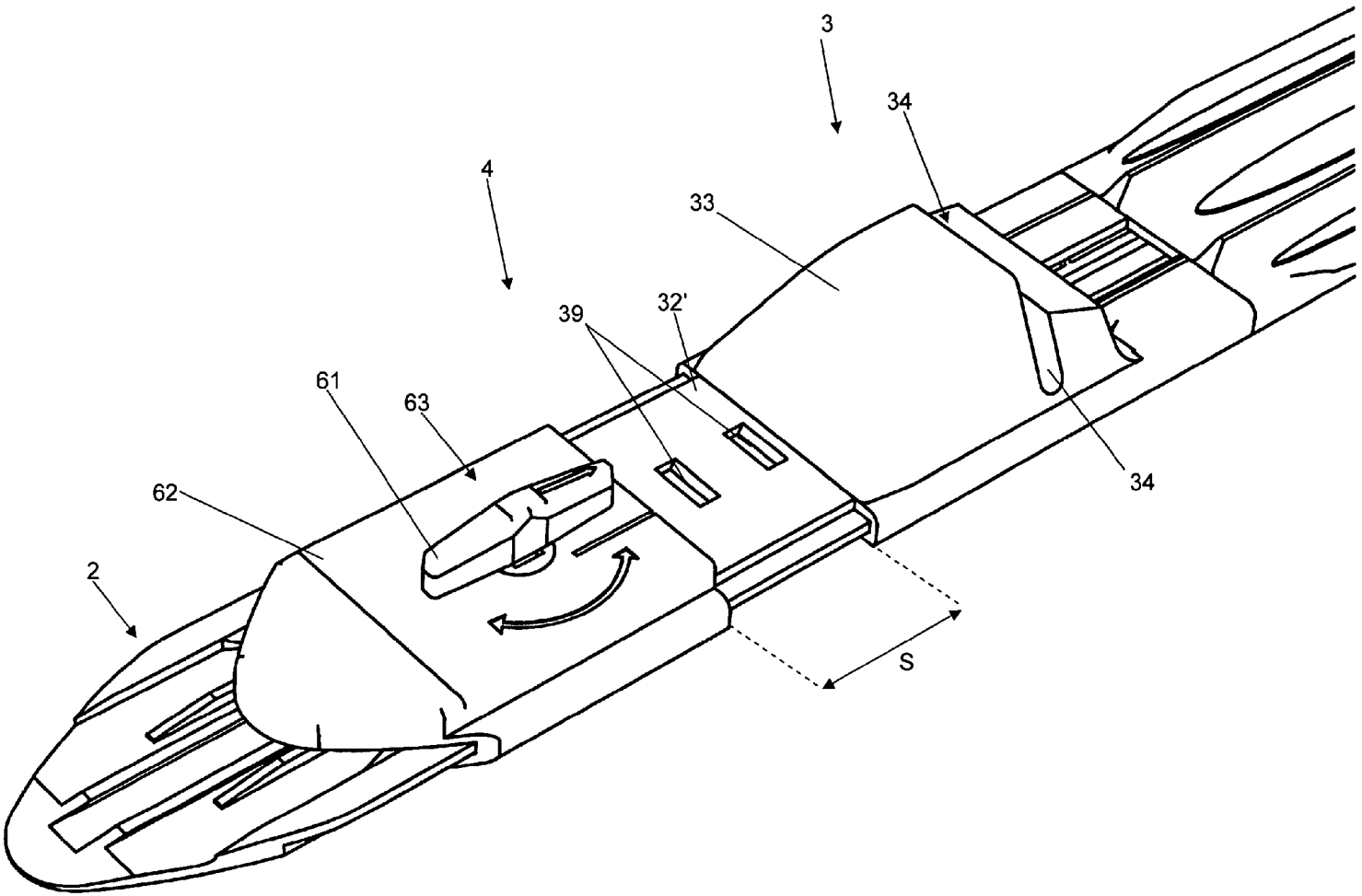
FIG. 10 shows a perspective view of the second unit according to a second embodiment of the present disclosure displaced on a mounting plate, as viewed in the second, glide position.

FIG. 9 and FIG. 10 show the comparison between the "kick position" (FIG. 9) and "glide position" (FIG. 10) in a perspective view of the second unit 4 in detail. Here, the maximum shift S of the first unit 3 with respect to the second unit 4 can be better appreciated.

Figure 11:
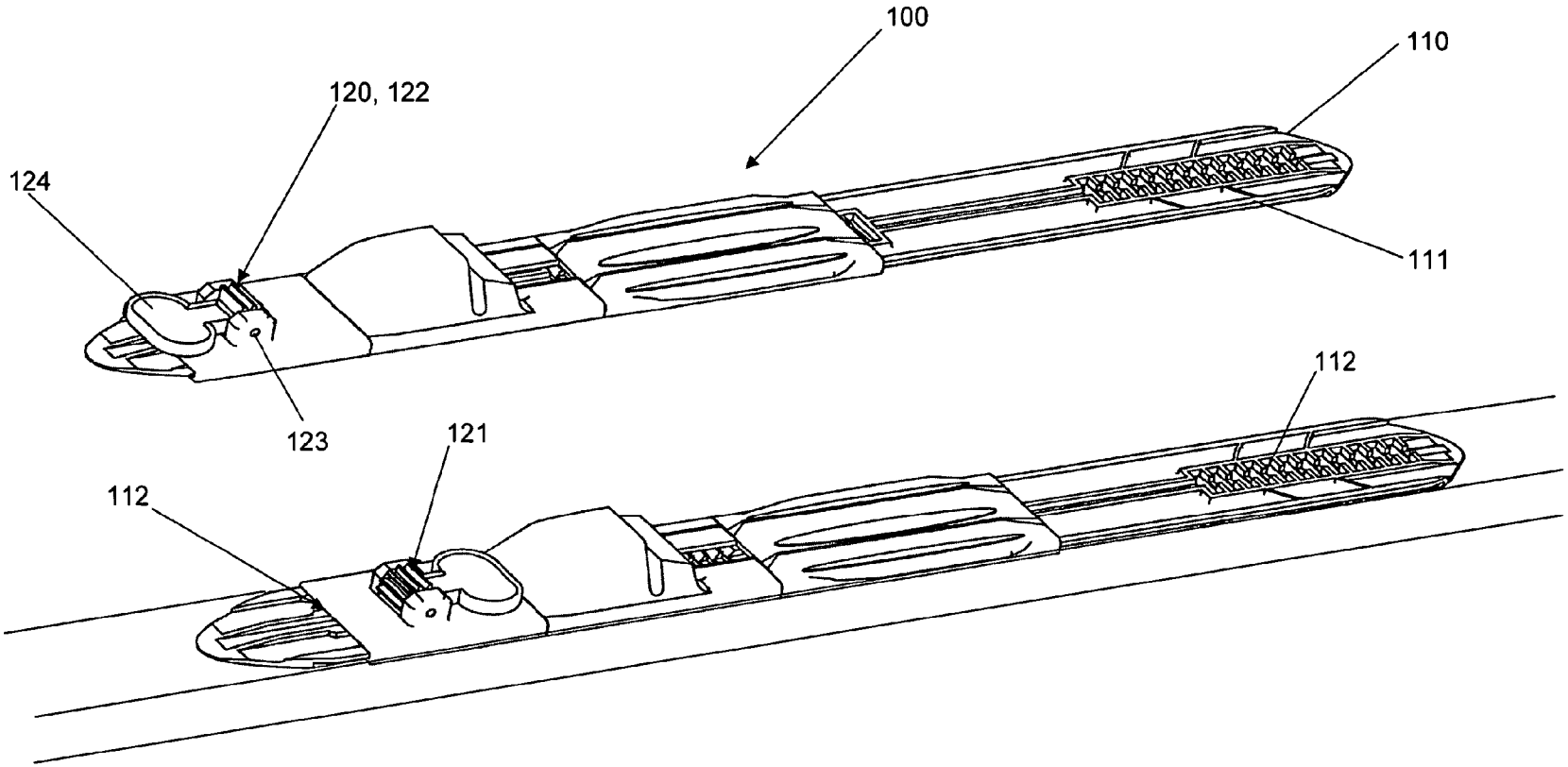
FIG. 11 shows an example of a moveable binding wherein the toothed interaction device is provided with a rotation axis perpendicular to the direction of travel of the binding.

FIG. 11 shows a further structure for providing a ski binding 100 for a ski, preferably a cross-country or touring ski, in which the binding 100 can be moved over the surface of the ski. The structure shown in FIG. 11 is one in which the binding 100 interacts with the ski via a mounting plate 110. The mounting plate is similar to, or the same as, the mounting plate 110 discussed above, and is intended to be, preferably semi-permanently or permanently, affixed to the ski in one of a variety of manners. It is possible for the mounting plate 110 to be stuck to the upper surface of the ski by means of an appropriate adhesive, or the mounting plate 110 can be welded or screwed to the ski. Indeed, the mechanism of fixing the mounting plate 110 to the ski is not altogether relevant for the interaction with the binding 100 and the ski.

Whilst the embodiment shown in FIG. 11 is a binding 100 interacting with the ski through a binding plate 110, it is also possible for the binding 100 to interact directly with the ski. If the ski were to be provided with appropriate fixing mechanisms such that the binding 100 could be attached to the ski directly in a slidable manner, the elements of the binding 100 being discussed below can interact directly with the ski. Obviously, it is a further advantage to use the mounting plate 110, as this improves the workability and construction of the ski, as the necessary portions for interacting with the binding 100 need not be constructed in an integral manner with the ski during, or after, manufacture.

As has been discussed above, the binding 100 should interact with the ski or mounting plate 110 in a slidable manner. In the following discussion, the possibility of interacting the binding 100 with the ski via a mounting plate 110 is discussed; this is not intended to be limiting, as it will be clear that appropriate structures provided on the mounting plate 110 could be incorporated into the ski, such that the binding 100 interacts in the manner described below directly with the ski and not through the mounting plate 110.

The slidable interaction between the binding 100 and the mounting 110 is by means of the mounting plate 110 having a ridge or lip along the longitudinal side, such that a flange or folded over portion on the lower side of the binding 100 can interact with the lip 111 of the mounting plate 110. The use of a channel on the binding 100 either side of the longitudinal length of the binding 100 provides a simple mechanism for interacting with the mounting plate 110. Obviously, it is also possible for the mounting plate 110 to be provided with the channel by means of the edge of the mounting plate 110 being bent round into a lip or flange configuration, such that the edges of the binding 100 can simply slideably engage with the channel formed along the edge of the mounting plate 110.

It is intended that the interaction between the binding 100 and the mounting plate 110 be such that the binding 110 can slide back and forth over the mounting plate 110. That is, the mounting plate 110, and the lip 111, if this is the mechanism chosen, are intended to hold the binding 100 to the top of the ski, however it is still possible for the binding 100 to move over the top of the mounting plate 110 in the longitudinal direction, which is the front to back direction of the ski and mounting plate 110, in a relatively free manner. Relatively free in this sense, indicates that the binding 100 should have no translational movement with respect to the mounting plate 110 other than this longitudinal sliding over the lip or channel of the mounting plate 110, and in all other respects the binding 100 is firmly held to the ski. In other words, the binding 100 has no play between the lip 111 and the channel of the binding 100, or vice versa, such that the binding 100 will not waggle or rock in its interaction with the mounting plate 110 and is properly affixed to the ski. As a result of this tight interaction between the binding 100 and mounting plate 110, the skilled person will appreciate that some degree of friction exists between the binding 100 and the mounting plate 110, such that the binding 100 will slide over the mounting plate 110, but requires some small force to move the two with respect to each other. In other words, the binding 100 will not readily slip over the top and slide with respect to the mounting plate 110, and the user must use some force in order to move the two with respect to each other.

As is presented in previous discussion of the mounting plate 110, the upper surface can be provided with a series of notches or indents, which can be used for positioning the binding 100 on the ski. It is these notches and indents which will also need to be translated into the ski if a design without the mounting plate 110 is considered. In the present case, the notches or indents 112 can actually be used to facilitate and/or fix the translational motion of the binding 100 with respect to the mounting plate 110. Positioning some form of toothed device 120 on the binding 100, allows for the teeth 121 of the device 120 to interdigitate, interact or engage with the notches and indents in the mounting plate 110, and in particular the upper surface of the mounting plate 110. As will be appreciated, the toothed device 120 can be used to appropriately fix the relative position of the binding 100 and the mounting plate 110, by means of the location of the toothed device 120 with respect to the indents or notches 112 on the mounting plate 110.

In the example shown in FIG. 11, the toothed device 120 is held in a rotatable manner within the binding 100. In particular, the toothed interaction device of this example can be seen as a cogwheel 122 which has protruding teeth 121 appropriately aligned with the indents or notches on the mounting plate 110. Further, as the skilled person will appreciate, the teeth 121 can extend slightly below the lower surface of the binding 100, such that the teeth 121 can be made to interdigitate with the indents or notches of the mounting plate 111. Interdigitation of the teeth 121 and notches 112 on the mounting plate 110, will obviously allow for rotation of the toothed device 120, in this case the cogwheel 122, to move over the mounting plate 110 in a known manner. That is, the rotation of the cogwheel 122 will interdigitate the teeth 121 with these notches 112 and translationally move the cogwheel 122 over the upper surface of the mounting plate 110.

As will be appreciated, if the cogwheel 122 is held in a translationally fixed, but rotatable manner on the binding 100, the binding 100 will move with the cogwheel 122 over the mounting plate 110 as the cogwheel 122 is rotated. Providing the cogwheel 122 with an axle 123, such that the cogwheel 122 is rotationally held in the binding 100, will allow rotation of the cogwheel 122 to push or move the binding 100 back and forth along the longitudinal direction of the mounting 110. The cogwheel 122 is thus appropriately translationally fixed in the binding 100 by means of the axle 123. In this manner, the translational position of the binding 100 over the mounting plate 110 can be adjusted simply by rotating the cogwheel 122.

In the example shown in FIG. 11, the cogwheel 122 is provided with a lever 124 which aids the user's interaction with the cogwheel 122. Obviously, the lever 124 is shown by way of example, and could be structured in a different manner. For example, the lever 124 could be replaced by a different shaped portion of the cogwheel 122 which allows the user to gain enough purchase to facilitate the rotation of the cogwheel 122 and the translational movement of the binding 100 over the mounting plate 110. Further, if a wheel is provided instead of the handle 124, a further device or movement pin could be provided, which could perhaps be fixed in a clip-like fashion to the binding 100 to ensure that it is not lost, and this could interact with a rotational wheel—for example, the wheel could be provided with a series of holes or ridges into which the movement pin is interlocked and temporarily fixed, such that the pin can provide a removable handle which facilitates the rotation of the wheel, which in turn rotates the cogwheel 122.

In order for the cogwheel 122 to interact with the binding plate 110, it is important that the teeth 121 interlock with the indents or notches 112 of the mounting plate 110. In the example given, the teeth 122 are intended to extend below the lower surface of the binding 100. Obviously, the inverse could be true, and the mounting plate 110 could be provided with a raised section in which the indents and notches, and the like, are slightly higher in the mounting plate 110, such that they will interact with the teeth 121 of the cogwheel 122. As is further clear from FIG. 11, the axle 123 holds the cogwheel 122 in a manner such that the rotational axis of the cogwheel 122 lies perpendicular to the longitudinal direction of the binding 100, mounting plate 110 and ski. In this orientation, the teeth 121 are also extended in the transverse direction, and will interact with notches which are also provided in the transverse direction on the mounting plate 110.

In order to allow the binding 100 to slide onto the mounting plate 110 for the first time, it is possible to provide the cogwheel with a section without teeth 121. In this engagement/disengagement position, the teeth 121 on the cogwheel 122 are all located away from a position which would interact with the notches, ridges or indents of the mounting plate 110, such that the user may move the binding 100 over the mounting plate 110, and no interaction between the cogwheel 122 and the notches or indents 112 will occur. This will clearly allow the slidable engagement and disengagement of the binding 100 with the mounting plate 110. Alternatively, the mounting plate 110 could be provided with a section to the front or back, in the skiing direction, of the mounting plate 110 in which no upward extensions are provided, such that the cogwheel 122 has nothing to interact with before the indents, notches or ridges of the mounting plate 110. In this manner, the binding could be slid onto the mounting plate 110 prior to the teeth 121 engaging the notches or ridges 112, and then the teeth 121 will engage with the first of the notches or indents 112 and would allow the rotation of the cogwheel 122 to move the binding 100 over the mounting plate 110.

In a different example, it would be possible for the toothed device 120, in this case the cogwheel 122, to be provided as a separate snap-in unit. This is not shown in any of the figures. Clearly, the binding 100 could be structured such that a recess is provided in the binding 100 into which the toothed device 120 can be snap fit, in this case the cogwheel 122 however in the example shown in FIGS. 12 and 13 a different structure is provided for this toothed interaction device. Such a mechanism would then allow the toothed device 120 to be clip-fit into the binding 100 when the binding 100 is positioned on the mounting plate 110. In this manner, the binding 100 would be attached to the mounting plate 110 without any concern of the teeth 121 interacting with the notches and indents 112 of the mounting plate, and then once the binding was appropriately in position, the insert portion comprising the toothed device 120 would be snap-fit into the appropriate receiving portion of the binding 100 thus allowing the teeth 121 to interact with the notches and indents 112 in the manner disclosed above. Further, it is possible for the toothed device 120 to have certain orientations in which the device 120 is held in rotational alignment with respect to the binding 100, such that perhaps one of two orientations are possible for the toothed interaction device 120. In the example shown in FIG. 11, for example, the handle 124 could clip into an appropriate recess with a retaining lip in each of the forward and reverse orientations, such that the binding 100 would be held in one of two positions with respect to the mounting plate 110.

Figure 12:
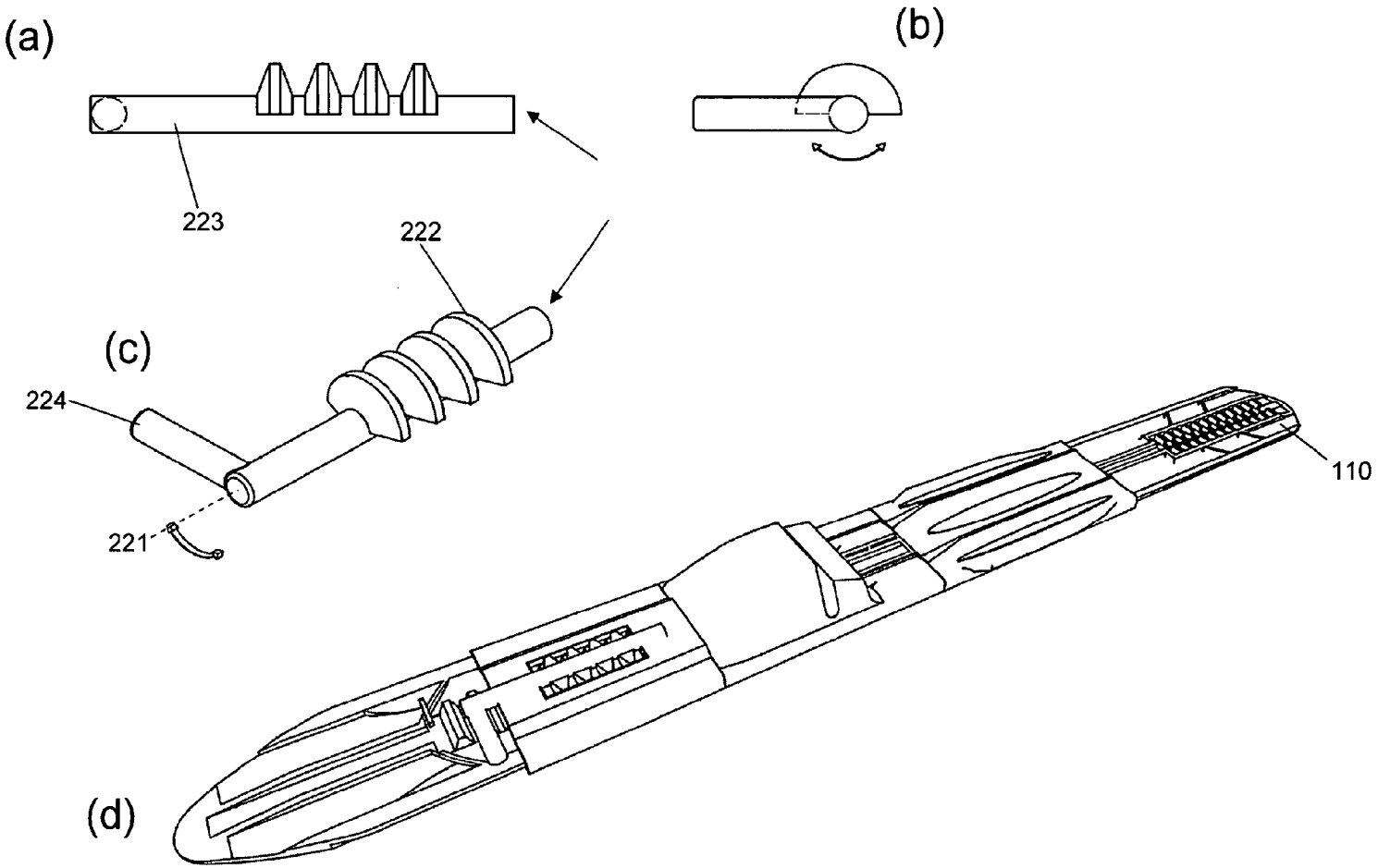
FIG. 12 shows a moveable binding wherein the toothed interaction device has a rotation axis which allows engagement or disengagement of teeth with notches of a binding plate.

In the same manner as described for FIG. 11, the device shown in FIG. 12 also provides a rotational device with teeth 220 which interact with the indents or notches 112 provided on the mounting plate 110. Again, the use of the mounting plate 110 is not vital and the provision of the notches, indents or ridges 112 could be made on the ski, such that interaction with the toothed device 220 will allow the translational positioning of the binding 200 on the ski. In the example shown in FIG. 12, it is clear that the toothed device 220 is structured differently and rotates along an axis 221 which lies in the longitudinal direction of the binding 200 and mounting plate 110. In the example shown in FIG. 12, the teeth 222 of the toothed device 220 are provided as hemispherical projections projecting from one side of a central rod or bar 223. The rod or bar 223 acts as the rotation point of the toothed device 220, and is aligned with the axis of rotation 221. From this, it is clear that the bar 223 will lie in the longitudinal direction of the binding 200 and mounting plate 110.

The toothed device 220 is structured such that the hemispherical teeth 222 may extend below the lower side of the binding 200 and can properly interact with the indents or notches on the upper surface of the mounting plate 110. Positioning the toothed device 220 in the binding in a rotatable manner, allows for the teeth 222 to be brought into, and out of, engagement with the notches and ridges on the upper surface of the mounting plate 110. That is, in one orientation, the teeth 222 will extend downward toward the mounting plate 110, such that the teeth 222 will interact and interdigitate with the notches and indents 112 of the mounting plate 110. Rotating the toothed device 220 from this first orientation into a second orientation, will allow for the teeth 222 to extend upward out of the upper surface of the binding 200 such that they will not interact with the notches and indents on the upper surface of the mounting plate 110. This can be made easier by means of a gripper handle 224 in the same manner as in the example given in FIG. 11.

As will be understood, in the first orientation the teeth 222 will hold the translational position of the binding 200 with respect to the mounting plate 110. In this orientation, the slidable motion between the binding 200 and the mounting plate 110 is not possible, and the position of the binding 200 will be held in this location. By rotating the toothed device 220 into the second orientation, the teeth 222 no longer interact with the indents or notches or ridges of the mounting plate 110, and the translational slidable motion of the binding 200 with respect to the mounting plate 110 is not stopped. In this case, the user could move the location of the binding 200 with regard to the mounting plate 110, until the desired location is found, at which point the toothed device 220 is rotated back to the first orientation such that the teeth 222 interact with the notches and ridges 112 and hold the binding 200 at this relative translational position with regard to the mounting plate 110.

In the same manner as described above for FIG. 11, the toothed device 220 could be held in a frictional or clip-fit manner in each of the two orientations. The handle 224 could interact with a slot or ridge on the upper surface of the binding 200, such that the rotational device 220 is held in the first orientation in a semi fixed manner which will stop the accidental rotation of the toothed device 220 as skiing is being undertaken. The user would then have to provide some force to disengage the teeth 220 from the notches or indents 112 of the mounting plate 110 in order to rotate the toothed device 220 into the second orientation in which translational motion of the binding 200 over the mounting plate 110 is possible. The figure shows a number of teeth 222 on the toothed device 220, although this is not considered as a limiting factor. Indeed, one tooth 222 would obviously provide the necessary fixing capability and interaction with the notches or ridges 112, and multiple teeth are shown by example only. It will be understood, however, that multiple teeth will lead to more interaction points between the binding 200 and the mounting plate 110 which will improve reliability.

Figure 13:
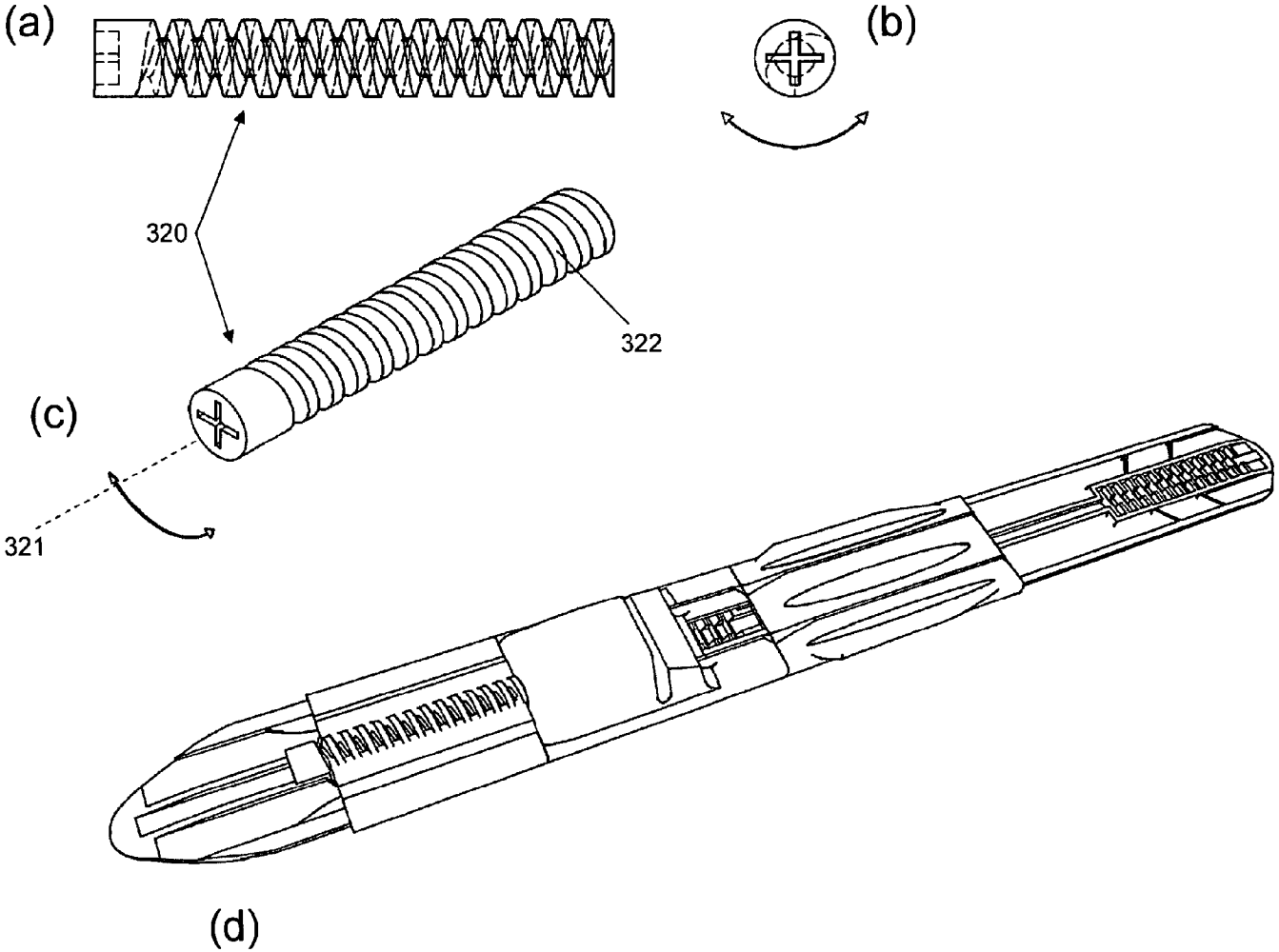
FIG. 13 shows a binding in which the toothed interaction device is provided by a worm screw.

The example given in FIG. 13 is very similar to that given in FIG. 12. In the toothed interaction device 320 of FIG. 13, the teeth 322 are provided by means of a worm thread gear. In this case, it is clear that the rotational device 320 will rotate along the axis 321, again lining longitudinally with regard to the longitudinal axis of the binding 300 and mounting plate 110, such that the extensions 322 of the worm thread will interact with the notches or ridges 112 of the mounting plate 110. As will be clear to the skilled person, continuous rotation of the toothed device 320 will lead to the screw thread teeth 322 moving the binding 300 in the forward and backward directions over the surface of the mounting plate 110. In all other respects, the design of FIG. 13 is quite similar to that of FIG. 12, especially with regard to the central part aligning with the axis of rotation 321.

In the example shown in FIG. 13, the toothed device 320 can be provided with its own cogwheel to improve the user interaction and to allow for the rotation of the toothed device 320 such that the worm thread teeth 322 will interact with the notches or ridges 112. Again this is by way of example only, and some other form of rotational aid could be provided, in the same manner as given above a wheel with holes could be provided and a rod for interacting with the holes such that the rod could be temporarily held within the holes and the rotation of the wheel will lead to rotation of the toothed device 320.

As is also given for the device of FIG. 11, the device in FIG. 13 could be provided with a toothed device 320 in which a radial portion, or slice, of the worm screw is missing to allow for the initial positioning of the binding 300 on the mounting plate 110. If the orientation of the worm screw is in this position, no teeth 322 extend and interact with the notches and ridges 112 of the mounting plate 110, and the binding 300 can be slid and interact with the mounting 110 prior to first use.

In the same manner as described for FIG. 11, the toothed interaction device of both FIGS. 12 and 13 could be provided as a separate unit which can then be snap-fit into the binding 200, 300 when the binding 200, 300 is appropriately slid onto the mounting plate 110. In this case, it would obviously not be necessary to provide the worm thread 322 of the toothed device 320 with a gap portion in the radial direction to allow first engagement of the binding 300 with the mounting plate 110, as the binding 300 would be slid into engagement with the mounting plate 110 prior to engagement of the snap-fit portion.

Also, the screw thread of FIG. 13 could be provided with appropriate notches or a portion which interacts with notches on the binding 300, such that the toothed device 320 would rotate and be fixedly positioned in its rotational motion to avoid unwanted rotation of this worm thread when the binding 300 is in use. Any known system for this friction and clip interaction would be appropriate, and would allow for a fully translational positioning of the binding 300 with respect to the surface of the mounting plate 110. It is also possible to provide each of the toothed interaction devices 120, 220, 320 out of a metal material, so as to improve the strength of this device in its interaction with the mounting plate 110. Obviously, a suitably rigid and strong plastic material could also be used. Further, it is advantageous if the teeth on the toothed interaction device 120, 220, 320 are of the same, or very similar, dimension to the notches or indents on the mounting plate 110, as this will improve the reliability of the interaction between the two and will reduce translational play.

Figure 14:
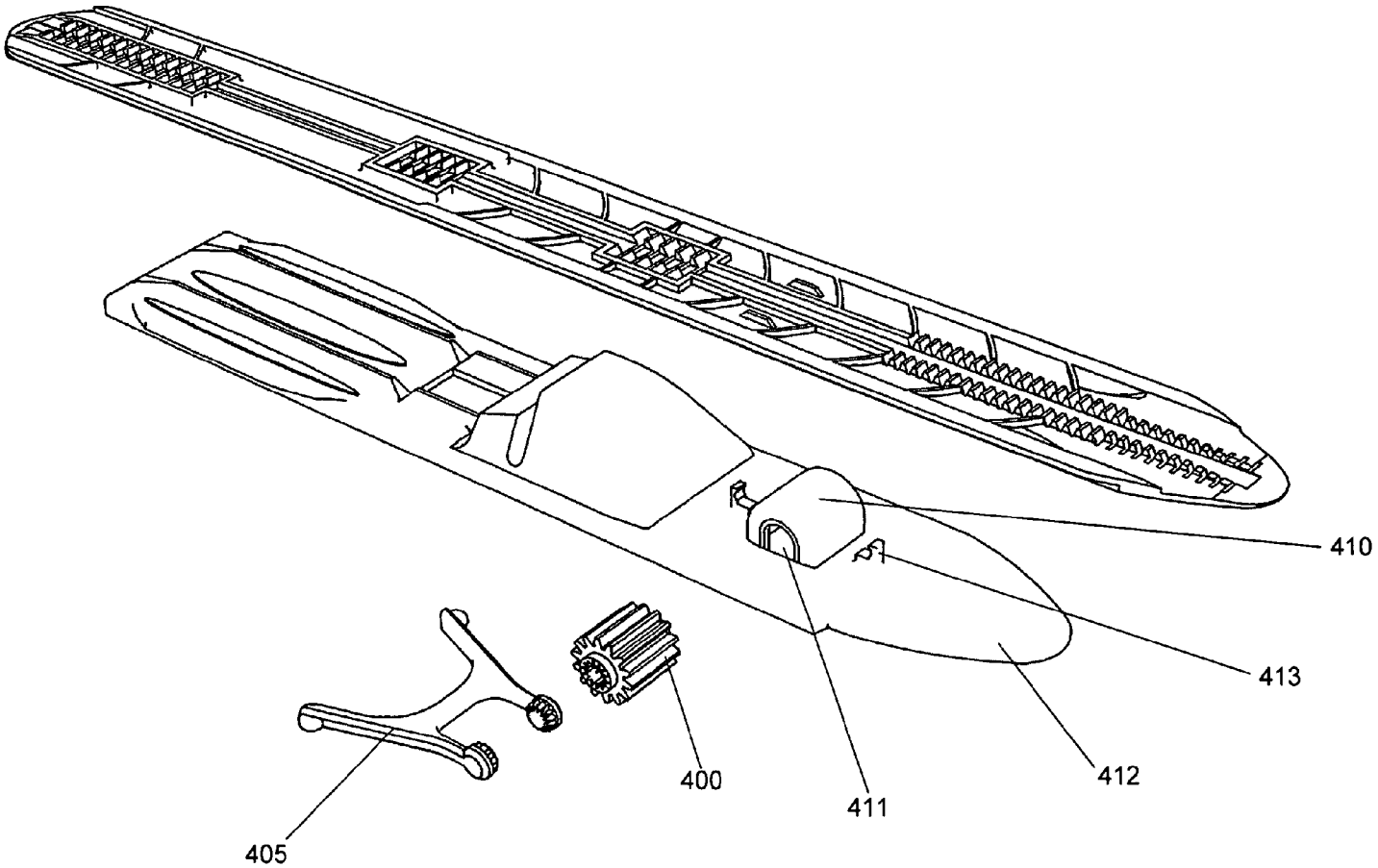
FIG. 14 shows a binding in which a toothed interaction device and removable handle allow the longitudinal positioning of the binding with respect to the ski.
Figure 15:
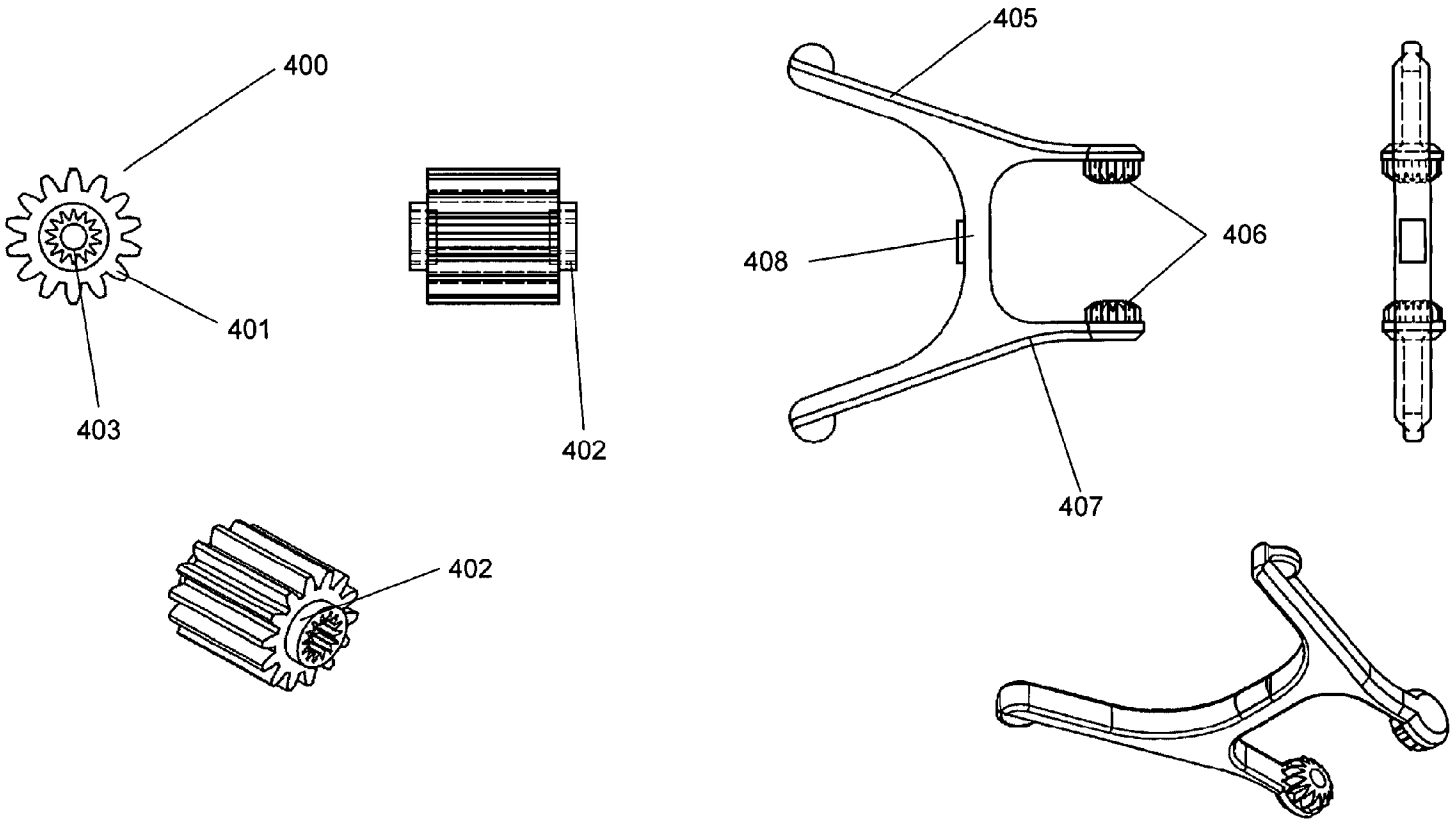
FIG. 15 shows further details of the cogwheel and removable handle as seen in FIG. 14.

FIGS. 14 and 15 show another binding 412 design which allows for the binding to be shifted forward and backward in the direction of travel of the ski. In FIG. 14, the binding 412 is positioned next to a mounting plate which can be attached to the upper surface of the ski. As with the previous descriptions, however, it is possible for the binding 412 to interact directly with the upper surface of the ski. The concept of use of the binding 412 of FIGS. 14 and 15 is similar to that above, in that a toothed interaction device is intended to lock with slots or ridges on the mounting plate or upper surface of the ski, wherein rotation of the toothed interaction device will move the binding 412 as the toothed device is held rotatably within the binding 412.

As can be seen from FIG. 14, the toothed interaction device in this design is a cogwheel 400. The cogwheel 400 is provided with a number of toothed extensions or teeth 401 which run along the axial direction of the cogwheel 400, and extend radially outward from the cogwheel centre. The teeth 401 are intended to interact with the slots or ridges on the ski or mounting plate, such that the teeth 401 can fully integrate and be used to help position the binding 412 at the desired location on the ski. As is clear from FIGS. 14 and 15, the cogwheel 400 is somewhat barrel-shaped, as this allows for a longer tooth 401 for interaction with slots on the ski or mounting plate. It is not necessary, however, for the cogwheel 400 to be extended in the axial direction.

Projections 402 are provided either side of the cogwheel 400, wherein the projections 402 may be used to act as the axial or rotation point of the cogwheel 400 when housed within the binding 412. The cogwheel 400 needs to be held in a rotatable manner within the binding 412, however relative translational motion between the cogwheel 400 and the binding 412 should be avoided, so as to ensure that rotation of the cogwheel 400 will allow the teeth 401 to interact with the ridges and move the binding 412.

FIG. 14 shows a housing 410 extending upwards and out of the upper surface of the binding 412. The housing 410 is provided to house the cogwheel 400, and is preferably structured such that only the lower projecting teeth 401 of the cogwheel 400 will extend below the lower surface of the binding 412 and can thus interact with the teeth on the ski or mounting plate. In order to house the cogwheel 400 in a rotatable manner, the housing 410 is provided with two slots 411 either side of the housing 410. The slots 411 are intended to appropriately house the preferably circular projections 402, such that the projections 402 fitting within the slots 411 will appropriately hold the cogwheel 400 in a rotatable manner within the housing 410.

As can be appreciated from FIG. 14, if the cogwheel 400 is positioned through the underside of the binding 412 in an appropriate hole through into the housing 410, the projections 402 will fit within the slots 411 and will house the cogwheel 400 in a translationally fixed but rotatable manner. The binding 412 can then be slid over projections in the mounting plate or ski in the same way as for the above examples. The binding 412 is provided on the underside with flanges or slots or the like, such that these can interact with extensions on the ski or binding plate and will allow the binding 412 to slide onto the ski or mounting plate and be held in a desired location, this being in the forward and backwards direction along the direction of travel of the ski, on the ski. As will be appreciated, the cogwheel 400 being positioned within the housing 410 will engage with the slots or ridges on the mounting plate or ski as the binding 412 is slid into position. The cogwheel 400 can freely rotate at this point within the slots 411 of the housing 410, and thus the binding 412 can be slid into interaction with the mounting plate or ski and located at the desired position on the ski. Desirably, the user could move the binding 412 by hand and will thus be able to properly position the binding 412 at the desired point on the ski.

In order to fix the cogwheel 400 within the housing 410 such that it cannot rotate and the binding 412 cannot move over the surface of the ski or mounting plate, the rotation of the cogwheel 400 must be stopped. As seen in FIGS. 14 and 15, a rotation lever 405 can be provided, wherein the rotation lever 405 will interact with the cogwheel 400 and stop its rotation and thus fix the binding 412 to the ski. The rotation lever 405 is formed with a generally H structure, such that at one end of the rotation lever 405 some interaction mechanism for stopping the rotation of the cogwheel 400 can be located. In the design given, the first end of the rotation lever 405 is provided with toothed extensions 406 which extend toward each other on the inside of the lower portion of the legs 407. The toothed extensions 406 can be used to interact with an appropriate structure defined on the cogwheel 400, such that rotation of the cogwheel 400 leads to the same degree of rotation of the rotation level 405.

In particular, and as is most clearly seen in FIG. 15, the interior portion of the cogwheel 400 is provided with a hollow axial hole extending through both the projections 402 and the cogwheel 400. Whilst in the example shown the hole extends all the way through from one side of the cogwheel 400 to the other, it is also possible to have only appropriately shaped indents within either side of the projections 402 into the cogwheel 400. As can be seen from FIG. 15, the interior of the hole or indents is provided with radially projecting internal teeth 403. The internal teeth 403 number the same as the external teeth 401 on the cogwheel 400, however they extend into the hole or indent toward the rotation axis of the cogwheel 400. As will be appreciated from the figures, the toothed extensions 406 on the rotation level 405 can be used to slot into the hole or indent such that the toothed extensions 406 will properly integrate with the internal projecting teeth 403, meaning that the cogwheel 400 and removable rotation lever 405 will rotate as one body. As is clear from the figures, the rotation lever 405 is structured such that toothed extensions 406 are spaced apart either with identical width to the cogwheel 400 including projections 402, or are spaced apart with a slightly narrower distance. As such, when the removable rotation level 405 is positioned to interact with the cogwheel 400, the legs 407 are under a slight tension and will thus properly keep the interaction between the removable rotation lever 405 and the cogwheel 400.

It is intended that the removable rotation lever 405 be attached into the axial hole or indents after the binding 412 has been positioned on the ski or mounting plate. The cogwheel 400 will be free to rotate in the slots 411 without the removable rotation lever 405 being in place, and thus the binding 412 can be positioned at the correct section of the ski. Once the ideal position for the binding 412 has been located, the legs 407 of the rotation lever 415 can be spread apart slightly and the toothed extensions 406 can interact with the internally projecting teeth 413 in the hole or indent of the cogwheel 400. As will then be appreciated, movement of the rotation lever 405 will rotate the cogwheel 400 and will thus lead to movement of the binding 412 over the surface of the ski. The binding 412 can generally only be moved by a certain amount, which is a factor of the number of teeth 401 and the spacing of the ridges on the ski or mounting plate.

In order to properly fix the position of the binding 412, it is necessary to hold the rotation lever 405 in the desired position. In order to facilitate this holding of the rotation lever 405, it is possible to put or locate a number, preferably two, of clips 413 on the upper side of the binding 412. Positioning the clips 413 in such a manner that they will interact with the cross piece 408 of the "H" of the removable rotation lever 405, will allow for the rotation lever 405 to be locked in one of two orientations. Either the rotation lever is generally facing the rear side or end of the binding 412, or it is facing the front of the binding 412. In transitioning the rotation lever 405 from each of these two positions locked into the clips 413, it is clear that the cogwheel 400 will be rotated, and thus the binding 412 will be shifted over the surface of the ski. It will be appreciated that the rotation lever 405 can be any shape with two legs for holding the toothed extensions 406 and for interacting with the clips 413—the H shape is advantageous, however, in that squeezing of the upper legs can lead to the widening of the lower legs to allow engagement of the cogwheel 400.

It will be further appreciated that it could be possible to remove the rotation lever 405, thus allowing the cogwheel 400 to rotate freely again. In this manner, it is then possible for the user to either adjust the position of the binding 412 on the surface of the ski or mounting plate, or to completely remove the binding 412 from the ski or mounting plate. Obviously, by ensuring that the legs 407 of the rotatable lever 405 are held under tension, ensures that the removable rotation lever 405 will not easily fall off the binding 412, and thus security and solid positioning of the binding 412 is assured. As with the above examples it is also possible to provide the housing 410 and cogwheel 400 as a separate removable cartridge that can be clip-fit or snapped into the binding 412 as desired. Obviously in such an embodiment the rotation lever 405 will remain in a removable fashion.

Figure 16:
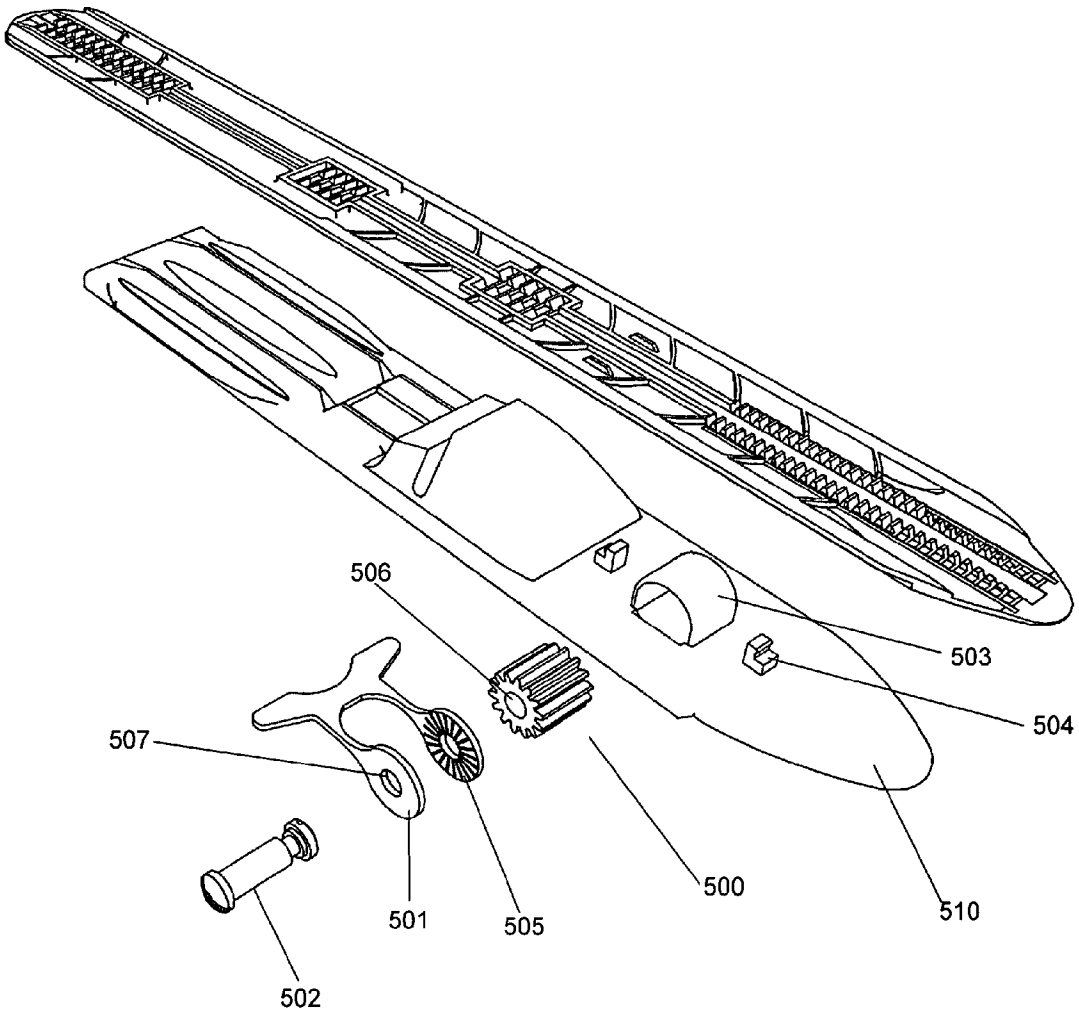
FIG. 16 shows a binding in which frictional forces can be used to hold the handle and cogwheel together for movement of the binding.

FIG. 16 shows a further possible structure for the binding 510 for interaction with a mounting plate or upper surface of a ski. In the same manner as described above, the ski or mounting plate is provided with a series of notches or ridges in the upper surface such that the binding 510 can interact therewith. The binding 510 is structured with appropriate slots on the underside thereof for fixing with flanges or the like on the mounting plate or ski in a similar manner to that described above, and thus further discussion will be omitted.

Within the binding 510, a toothed interaction device in the form of a cogwheel 500 is provided. The cogwheel 500 is similar to that described above for the example given in FIGS. 14 and 15, and has a series of radially extending teeth running along the outer surface thereof. The cogwheel could be provided in a generally extended cylindrical fashion, wherein the teeth run along the outer surface in the longitudinal direction whilst projecting outward in the radial direction.

The cogwheel 500 is held within a housing 503 provided in the binding 510. As is seen in FIG. 16, the housing 503 can extend above the upper surface of the binding 510 and is structured or positioned such that the extending teeth of the cogwheel 500 will extend below the lower surface of the binding 510 and can thus interact with the notches or ridges on the ski or mounting plate. In the same manner as above, the cogwheel 500 is held in a rotatable manner within the housing 503, such that the cogwheel 500 can rotate as the teeth engage with the slots or ridges on the mounting plate or ski surface as the binding 510 is translationally moved back and forth along the skiing direction of the ski. In order to fix the cogwheel 500 within the binding, a bolt element or fastener 502 is provided. The bolt fastener 502 provides a rotational axis by extending through the cogwheel 500 along the centre rotational axis point. In order to allow rotation of the cogwheel by the user, a handle 501 is positioned such that frictional surfaces 505 will interact with the end faces 506 of the cogwheel 500. As will be appreciated, if the frictional surfaces 505 can be engaged with the end faces 506 of the cogwheel 500, preferably by means of a squeezing force, the handle 501 will form a unit with the cogwheel 500 such that rotation of one will lead to rotation of the other.

In the example shown in FIG. 16, the bolt fastener 502 passes through holes 507 provided in the frictional surfaces 505 of the handle 501. The bolt fastener 502 also passes through a centre hole of the cogwheel 500 such that tightening of the bolt element 502 will bring the frictional surfaces into pressure and frictional engagement with the end faces 506 of the cogwheel 500. It will be understood that when the bolt fastener 502 is not tightened, the handle 501 and cogwheel 500 can rotate independently, which will allow the binding 510 to be positioned on the ski in roughly the desired location. The handle 501 can then be frictionally engaged with the end faces 506 of the cogwheel 500 by tightening the bolt fastener 502 and leading to a single unit being provided. In this case, rotation of the handle 501 will lead to rotation of the cogwheel 500 and with interaction between the teeth on the cogwheel 500 and the ridges or slots in the ski or mounting plate, the position of the binding 510 can be changed over the surface of the ski. In order to stop rotation of the handle 501 in one of two orientations, two clips 504 are provided at appropriate positions on the upper surface of the binding 510. The clips 504 will hold the handle 501 in a clip-fit manner thus stopping movement of the handle 501 and thus reducing the rotation of the cogwheel 500 and holding the binding 510 at the desired position on the ski or mounting plate.

As can be seen in FIG. 16, the bolt fastener 502 is provided with an outer tubular sleeve element which has an internal screw thread. The internal screw thread allows the screw engagement of a screw piece therein, such that the distance between the two heads of the bolt fastener can be increased or decreased by rotation of each element. It will be appreciated that the tubular element could be fixed in a non-rotatable manner with respect to the cogwheel 500, such that the cogwheel 500 and the outer tubular element of the bolt fastener 502 move as one. Likewise, it would be equally possible for the outer tubular element of the bolt fastener 502 to be held in a rotatable manner within the axial hole of the cogwheel 500, and the frictional engagement between the frictional surfaces 505 and end faces 506 of the cogwheel 500 lead to the fixing together of the cogwheel 500 and handle 501.

If the cogwheel 500 is structured with extensions extending along the axial direction either side of the rotation axis, as shown in FIGS. 14 and 15, the housing 503 can be structured with an appropriate slot to allow the rotational fixing of the cogwheel 500. In the same way as described for the example given in FIGS. 14 and 15, the axial protrusions will be held within slots of the housing 503 in a rotatable manner, and thus form the rotation axis between the housing 503 and the cogwheel 500. The end faces of the extensions or protrusions in the axial direction will then provide the end faces 506 of the cogwheel 500 for interaction with the frictional surfaces 505 of the handle 501. In this regard, the cogwheel 500 is held in a more rigid fashion to the binding 510 but the frictional engagement between the handle 501 and the cogwheel 500 is still possible by means of the end faces of these protrusions.

The present disclosure further relates to the provision of a binding system in which one or other of the bindings 100, 200, 300, 412 described in FIGS. 11-16 are provided with a mounting plate 110. That is, the specifics of this disclosure also relate to a proper system comprising both the bindings 100, 200, 300, 412 and the mounting plate 110, which has commercial advantages in that a kit can be sold to the end user. It is also possible to provide a spacer plate, not shown in the figures, which is positioned between the mounting plate 110 and one or other of the bindings. The spacer plate is appropriately structured such that it will interact with the lip 110 or flanges of the mounting plate 110, in the same manner as the bindings as described above, but will also present appropriate lip or notches or channels for binding 100, 200, 300 to fix directly to the spacer plate, rather than the mounting plate 110. Obviously, the spacer can also be provided for interaction with an appropriately structured ski, if the mounting plate 110 is not to be used.

The spacer plate will allow the positioning of the binding 100, 200, 300, 412 above the ski at a slightly higher position than would be possible with just the binding 100, 200, 300, 412 and mounting plate 110 or appropriately structured ski. Further, the spacer plate does not need to be completely flat, and can in fact be tapered in one or other direction. Indeed, the taper of the space plate could be such that the front portion of the binding 100, 200, 300, 412 is positioned closer to the ski, and the heel of the binding 100, 200, 300, 412 is positioned higher from the upper surface at the ski. Likewise, the inverse structure can be considered. Further, the spacer could be tapered in the transverse direction, such that the binding 100, 200, 300, 412 is angled either inward or outward, inward being the direction towards the skier when using the skis and outward being the opposite direction lying in the transverse direction of the skis, such that the angle of the binding 100, 200, 300, 412 is changed with respect to the upper surface of the ski. The spacer plate in this example can also be provided with the appropriate notches or indents for interacting with the portions described above in any of the figures, and is not necessarily limited to use with only the binding shown in FIGS. 11-15.

Whilst features have been presented in combination of the above description, this is intended solely as an advantageous combination. The above description is not intended to show required combinations of features, rather it represents each of the aspects of the disclosure. Accordingly, it is not intended that any described specific combination of features is necessary for the functioning of the ski binding 1.

The invention claimed is:

1. A binding for a ski, in particular a ski binding for a cross-country or touring ski, comprising:

a portion configured to engage the ski or a mounting plate attached to the ski, such that the binding is attached to the ski in a displaceable manner, and such that the binding can be positioned to bind a boot to the ski in a plurality of locations on the ski; and a toothed interaction device having a plurality of teeth arranged so as to interact with matching indents or notches on the ski or on the mounting plate, wherein the interaction of the teeth of the toothed interaction device with the matching indents or notches on the ski or on the mounting plate changes the position of the binding with respect to the ski, wherein the toothed interaction device is a cog wheel rotatably held at a fixed rotation location on the binding, and wherein teeth in the cog wheel engage matching indents or notches on the ski or mounting plate, such that rotation of the cog wheel displaces the binding forward or backward on the ski.

2. The binding of claim 1 wherein the toothed interaction device is provided with an extension, handle, wheel or lever which extends away from an axis of rotation of the device and allows a user of the binding to rotate the toothed interaction device.

3. The binding of claim 2, wherein the binding has one or more lips or clips which interact with the toothed interaction device and hold the toothed interaction device in one or more orientations within the binding, in particular where the one or more lips or clips interact with the extension, handle, wheel or lever.

4. The binding of claim 1, wherein the cog wheel teeth extend radially outward from a rotation axis, and wherein the rotation axis is provided by two circular extensions extending outward from a cog portion in an axial direction, and wherein the binding is provided with a housing for holding the cog wheel, wherein the housing extends upward from a top of the binding and is provided with two slots which match the outer profile of the circular extensions so that the cog wheel can be held in the housing in a rotatable manner by the slots.

5. The binding of claim 4, wherein the cog wheel is held by the slots in the housing such that lower teeth of the plurality of teeth extend below a lower surface of the binding such that they will interact with the matching indents or notches.

6. The binding of claim 4, wherein the cog wheel has either an axial hole running through the cog wheel and the circular extensions or an indent extending axially inward, wherein an internal surface of the axial hole or the indent is provided with a number of radially projecting internal teeth, comprising the same as the number of external teeth on the cog wheel.

7. The binding of claim 6, wherein the binding is provided with a removable rotation lever formed with an "H" profile, wherein toothed extensions are provided at an inner sides of two adjacent legs, wherein the toothed extensions match the shape of the axial hole or the indent in the cog wheel such that they can be positioned within the axial hole or the indent to allow movement of the rotation lever to move the cog wheel, and thus rotate the cog wheel within the housing of the binding.

8. The binding of claim 7, wherein the gap between the toothed extensions is smaller than the width of the cog wheel, such that after engagement of the rotation lever, the legs are held under tension and hold the rotation lever to the binding.

9. The binding of claim 8, wherein an upper surface of the binding is provided with two clips on either side of the housing, wherein the clips are located and structured to interact with a middle bar separating two side legs of the "H" profile rotation lever, so that the lever can be held in one of two orientations and the binding can thus be positioned in one of two locations on the ski.

10. The binding of claim 1, wherein the cog wheel comprises a plurality of teeth extending radially outward from a rotation axis, and wherein the rotation axis is provided by a bolt fastener running through the cog wheel, and wherein the binding is provided with a housing for housing the cog wheel, wherein the housing extends upward from a top of the binding and is provided with two holes through which the bolt fastener extends so that the cog wheel can be held in the housing in a rotatable manner, wherein the two holes are large enough such that entire end faces of the cog wheel are exposed, and further wherein a handle is provided which has two friction surfaces with holes therethrough, wherein the handle is structured and positioned such that the bolt fastener passes through the holes and the friction surfaces align with the end faces of the cog wheel such that with tightening of the bolt fastener the friction surfaces will be held against the end faces and will ensure that the handle and cog wheel rotate as one.

11. The binding of claim 10, wherein the bolt fastener is provided with an outer tube element which has an internal screw thread for mating with a screw element which screw fits within the tube and internal screw, and wherein the outer tube element and the screw element have bolt or screw heads which act against the handle to hold this frictionally with the cog wheel.

12. The binding of claim 10, wherein the upper surface of the binding is provided with one or more clips which interact with the handle to fix the handle in a desired orientation and thus stop rotation of the handle and cog wheel and therefore fix the location of the binding to the ski or mounting plate.

13. The binding of claim 10, wherein the cog wheel is provided with circular extensions extending outward in the from the cog wheel in the axial direction which provide the rotation axis for interacting with two matching slots in the housing of the binding, wherein end faces of the circular extensions provide an interface surface for interacting with the friction surfaces of the handle.

14. The binding of claim 1, wherein the binding further comprises long sides that are approximately parallel, or parallel, with long sides of the ski and further wherein the long sides comprise elongate flanges or lips that form an internal channel for slidably interacting with elongate matching flanges on the ski or mounting plate, wherein the binding elongate flanges or lips are configured to hold the binding to the ski or mounting plate, and wherein the toothed interaction device is configured to locate the binding at the desired location on the ski or mounting plate.

15. The binding of claim 1, wherein the toothed interaction device is provided in a separate removable cartridge, which is engageable in a clip fit manner with the binding.

16. A binding system comprising:

a mounting plate for attachment to an upper surface of a ski, in particular a cross-country or touring ski, by glue, or welding or screw fasteners; and a binding according to claim 1 which slidably attaches to the mounting plate, wherein the mounting plate is provided with indents or notches in a top surface thereof for interacting with the toothed interaction device to allow the positioning of the binding with respect to a longitudinal direction of the mounting plate.

17. The binding system of claim 16 further comprising a spacer plate, wherein the spacer plate is positionable between the binding and the mounting plate to increase the distance at which the binding will be located with respect to the ski to which the mounting plate is attached, wherein the spacer plate is provided with appropriate indents or notches for interacting with the toothed interaction device.

18. The binding system of claim 17, wherein the spacer plate has one of:

(a) a completely flat profile such that the whole of the binding is lifted the same distance from the mounting plate; or (b) a sloped or wedge shaped profile in the longitudinal direction of the mounting plate to tip the binding forward or backward; or (c) a sloped or wedge shaped profile in the width direction of the mounting plate to tip the binding to one or other side of the ski.

* * * * *